US011545329B2

(12) United States Patent
Kyrytsya et al.

(10) Patent No.: US 11,545,329 B2
(45) Date of Patent: Jan. 3, 2023

(54) THZ VACUUM ELECTRONIC DEVICES WITH MICRO-FABRICATED ELECTROMAGNETIC CIRCUITS

(71) Applicant: RaySecur, Inc., Cambridge, MA (US)

(72) Inventors: Volodymyr Kyrytsya, Sherbrooke (CA); Alexander Georg Sappok, Newton, MA (US)

(73) Assignee: RaySecur, Inc., Cambridge, MA (US)

( * ) Notice: Subject to any disclaimer, the term of this patent is extended or adjusted under 35 U.S.C. 154(b) by 148 days.

(21) Appl. No.: 16/952,568

(22) Filed: Nov. 19, 2020

(65) Prior Publication Data

US 2021/0159040 A1 May 27, 2021

Related U.S. Application Data

(60) Provisional application No. 62/939,382, filed on Nov. 22, 2019.

(51) Int. Cl.
*H01J 19/78* (2006.01)

(52) U.S. Cl.
CPC ..... *H01J 19/78* (2013.01)

(58) Field of Classification Search
None
See application file for complete search history.

(56) References Cited

U.S. PATENT DOCUMENTS 2,123,728 A 7/1938 Hollmann
2,889,487 A * 6/1959 Birdsall ..... H01J 23/083 333/163
4,163,921 A * 8/1979 Myers ..... B21C 37/124 445/35
6,448,850 B1 9/2002 Yamada
6,801,107 B2 10/2004 Chen et al.
7,649,328 B2 1/2010 Smirnov et al.
8,441,191 B2 5/2013 Protz et al.
9,368,313 B1 6/2016 McGuire
9,741,521 B1 8/2017 Perkins
9,819,320 B1 11/2017 Hoff et al.
2019/0279834 A1 9/2019 van der Weide et al.

OTHER PUBLICATIONS

Basten et al., "233 GHz High Power Amplifier Development at Northrop Grumman", Northrop Grumman Corp., 2016 IEEE International Vacuum Electronics Conference.
Booske et al., "Vacuum Electronic High Power Terahertz Sources", IEEE Transactions on Terahertz Science and Technology, vol. 1, No. 1, Sep. 2011.

(Continued)

*Primary Examiner* — Ashok Patel
(74) *Attorney, Agent, or Firm* — Nields, Lemack & Frame, LLC

(57) ABSTRACT

A new class of efficient vacuum electronic devices (VEDs) for THz wave generation and amplification are disclosed. The EM circuits of these VEDs are micro-fabricated from Si wafers with high precision. The original design of the EM circuits overcomes the main limitations of existing THz VEDs constructed from metal or metallized components, such as low fabrication precision, high signal losses, low tolerance to electric breakdown and low beam efficiency. The disclosed VEDs may have up to 50% beam efficiency in the THz band.

22 Claims, 25 Drawing Sheets

(56) References Cited

OTHER PUBLICATIONS

Calame et al., "Design and Large-Signal Modeling of a W-Band Dielectric TWT", IEEE Transactions on Plasma Science, vol. 45, No. 10, Oct. 2017.
Cook et al., "Observation of Narrow-Band Terahertz Coherent Cherenkov Radiation from a Cylindrical Dielectric-Lined Waveguide", Physical Review Letters, vol. 103, Aug. 2009.
Ives et al., "Development of Backward Wave Oscillators for Terahertz Applications", Thirteenth International Symposium on Space Terahertz Technology, Harvard University, Mar. 2002.
Kowalski et al., "An Overmoded W-Band Coupled-Cavity TWT", Plasma Science & Fusion Center, Massachusetts Institute of Technology, Dec. 2014.
Malekabadi et al., "High-Resistivity Silicon Dielectric Ribbon Waveguide for Single-Mode Low-Loss Propagation at F/G-Bands", IEEE Transactions on Terahertz Science and Technology, vol. 4, No. 4, Jul. 2014.
Marcatili, "Dielectric Rectangular Waveguide and Directional Coupler for Integrated Optics", The Bell System Technical Journal, pp. 2071-2102, Sep. 1969.
Pacey et al., "Continuously Tunable Narrow-Band Terahertz Generation with a Dielectric Lined Waveguide Driven by Short Electron Bunches", Physical Review Accelerators and Beams, vol. 22, 2019.
Srivastava, "Microfabricated Terahertz Vacuum Electron Devices: Technology, Capabilities and Performance Overview", European Journal of Advances in Engineering and Technology, vol. 2, pp. 54-64, 2015.
Temkin, "Volume Mode Traveling Wave Tube Amplifier, Final Report", Plasma Science and Fusion Center, Massachusetts Institute of Technology, Jul. 2020.
Tucek et al., "A Compact, High Power, 0.65 THz Source", 2008 IEEE International Vacuum Electronics Conference, Northrop Grumman Corp., 2008.
Tucek et al., "Operation of a Compact 1.03 THz Power Amplifier", 2016 IEEE International Vacuum Electronics Conference, Northrop Grumman Corp., 2016.
Zhang et al., "Coherent Terahertz Radiation from Multiple Electron Beams Excitation within a Plasmonic Crystal-like Structure.", Nature: Scientific Reports, Jan. 2017.
International Search Report and Written Opinion dated Feb. 9, 2021 in corresponding PCT application No. PCT/US2020/061229.
Yeh et al., "Low-loss Terahertz Ribbon Waveguides", Applied Optics, vol. 44, No. 28, Oct. 2005.

* cited by examiner

THZ VACUUM ELECTRONIC DEVICES WITH MICRO-FABRICATED ELECTROMAGNETIC CIRCUITS

This application claims priority of U.S. Provisional Patent Application Ser. No. 62/939,382, filed Nov. 22, 2019, the disclosure of which is incorporated by reference in its entirety.

BACKGROUND OF THE INVENTION

Vacuum electronic devices (VED) such as klystrons, traveling wave tubes (TWT), enhanced interaction oscillators (EIO) and their variants have been used for many decades to amplify or generate electromagnetic (EM) waves over a large frequency band from several KHz to tens of GHz with power levels up to tens of MW.

The beam efficiency (EM power/electron beam power) of the VEDs in lower than THz frequency bands is typically around 50% and higher. However, extending classical VEDs to higher frequencies i.e. THz band (100 GHz-10 THz) remains a challenging task for several reasons including the electron beam requirements and the electromagnetic circuit requirements.

First, with respect to the electron beam, the main limitation is the beam diameter, which must be less than one fourth of the wavelength of the generated EM signal. In one example, the electron beam diameter must be less than 250 μm for 300 GHz devices and less than 25 μm for 3 THz devices. In addition to the requirements of very small diameter electron beams, the beam integrity must be maintained and controlled within tight tolerances over the length of the device, with minimal beam spread. Thus, in order to generate the same power as lower frequency VEDs, THz VEDs must use cathodes with much higher current densities, in practice around 100 A/cm$^2$ in one example.

A further limitation of classical VEDs is the fact that the beam efficiency has a strong dependence on the electron beam current. In practice, this means that low power devices are usually less beam efficient than high power devices. The power and efficiency of experimentally demonstrated VEDs in the THz band is low and decreases rapidly with frequency. The best VEDs around 200 GHz have under 100 W of power and efficiencies of only several percent. At higher frequencies, 500 GHz and higher, the best VEDs have typically under 100 mW RF output power and beam efficiencies under 1%.

Beam efficiency directly impacts the performance of the device in two ways, specifically: (i) the input electron beam power requirements, and (ii) heat generation. In one example, a VED with low beam efficiency would require a high electron beam power input to the EM circuit (with associated higher cost and complexity) and also results in more energy lost as heat. Heat rejection requires additional thermal management, which becomes more critical as the device becomes smaller and is one factor limiting the development of small, low-cost VEDs for these applications.

With respect to the EM circuit, the main factors limiting their application in the terahertz frequency range are:

I. High precision requirements. The small size scale of the component features cannot be met with conventional manufacturing processes. The short wavelength of the THz waves puts limitations on the size of the electromagnetic circuit and the precision of fabrication. In practice, the EM active parts of the circuit must be scaled down to sub-millimeter size and the fabrication precision must be around one micron and less. The fabrication of the structures with such features and tolerances has not been possible using conventional techniques such as micromachining and the like for high volume and low-cost applications.

II. Another important limiting factor for THz VED efficiency is the ohmic losses of the THz signal inside metal EM circuits and waveguides. These losses are much higher in the THz frequency range than in lower frequency bands. The ohmic losses not only reduce the THz signal power but also may cause thermal damage to the circuit itself.

III. Small THz EM circuits are much more vulnerable to electrical breakdown of the materials and arcing because for the same input or output RF power, the electric fields are higher and more concentrated for smaller circuits. The high-power densities present significant durability challenges, which must be addressed.

IV. Poor interaction between the electromagnetic waves and the electron beam, which contribute to low efficiency and high power requirements of the device. These requirements exacerbate the challenges related to the small size of the device, such as high losses and issues related to heat dissipation and electrical breakdown described in I-III above.

Current approaches to THz VEDs rely on either micromachining of metallic components or fabrication of micro-scale components and structures from silicon (Si) wafers via etching and related micro-fabrication processes to maintain high dimensional tolerances. In the case of microfabricated Si parts, they are subsequently metalized such as by metallic deposition processes, to form metallic structures such as cavities, resonators, metalized slow wave or comb-type structures, and waveguides. Such metal-based VEDs, whether micromachined, or microfabricated from dielectric wafers and metallically plated, still suffer from many of the limitations described above.

Therefore, it would be advantageous if there was a VED that did not rely on traditional materials.

SUMMARY OF THE INVENTION

A new class of low-cost, scalable, and high efficiency vacuum electronic devices (VED) for THz wave generation and amplification is disclosed. The electromagnetic circuits of these VEDs are micro-fabricated from wafers such as silicon or similar materials with high precision. The use of wafer processing methods combined with novel microfabrication techniques and original electromagnetic (EM) circuit designs overcome the limitations of existing THz VEDs. The disclosed VEDs may have up to 50% beam efficiency, or more, in the THz band. These VEDs utilize silicon or related dielectric materials to serve as the waveguides themselves, thereby overcoming the limitations faced by conventional approaches.

According to one embodiment, a vacuum electronic device for THz wave generation or amplification is disclosed. The device comprises a vacuum enclosure containing: a cathode and an anode for generating an electron beam; a dielectric ribbon waveguide mounted on a fixture in close proximity to the electron beam; wherein the dielectric ribbon waveguide is configured to operate at a mode to generate an electric field extending beyond its surfaces to interact with the electron beam to amplify or generate terahertz energy; and an antenna or interconnect for transmitting the terahertz energy out of the vacuum enclosure.

In certain embodiments, the dielectric ribbon waveguide comprises an integral electron beam splitter. In certain embodiments, the integral electron beam splitter comprises fins extending into the fixture. In some embodiments, the integral electron beam splitter is metalized.

In certain embodiments, an external magnetic field is used to control and align the electron beam. In some further embodiments, the external magnetic field is generated by a solenoid. In certain further embodiments, the external magnetic field is generated by permanent magnets.

In some embodiments, the dielectric ribbon waveguide is silicon. In certain embodiments, the dielectric ribbon waveguide is partially coated with metal at its ends. In some other embodiments the dielectric waveguide is not coated with metal and is unclad.

In all embodiments the dielectric ribbon waveguide enables an electric field to extend from within the waveguide through one or more of the waveguide surfaces and extend beyond the surface of the waveguide to interact with its surroundings.

In certain embodiments, the dielectric ribbon waveguide comprises an integrated coupler to transfer the amplified or generated terahertz energy to the antenna or interconnect. In some further embodiments, the integrated coupler comprises a tapered end and acts as the antenna. In some further embodiments, the integrated coupler is metalized and acts as a high-pass filter. In some further embodiments, the integrated coupler comprises a tapered end to act as a 2D or 3D antenna array. In some further embodiments, the integrated coupler has modified electromagnetic properties and acts as an absorber.

In certain embodiments, wherein the output power and frequency of the vacuum electronic device is controlled by a control unit.

In certain embodiments, the antenna comprises an antenna-collector to collect generated electrons.

In certain embodiments, the dielectric ribbon waveguide functions as a traveling wave tube, an enhanced interaction oscillator, a klystron, or a magnetron.

In some embodiments, the device comprises more than one dielectric ribbon waveguide.

In certain embodiments, the dielectric ribbon waveguide is a linear element.

In certain embodiments, the dielectric ribbon waveguide is a loop.

In some embodiments, more than one electron beam is generated.

In certain embodiments, material properties of the dielectric ribbon waveguide are homogenous. In some embodiments, material properties of the dielectric ribbon waveguide are inhomogeneous.

DETAILED DESCRIPTION OF THE INVENTION

Figure 1A:
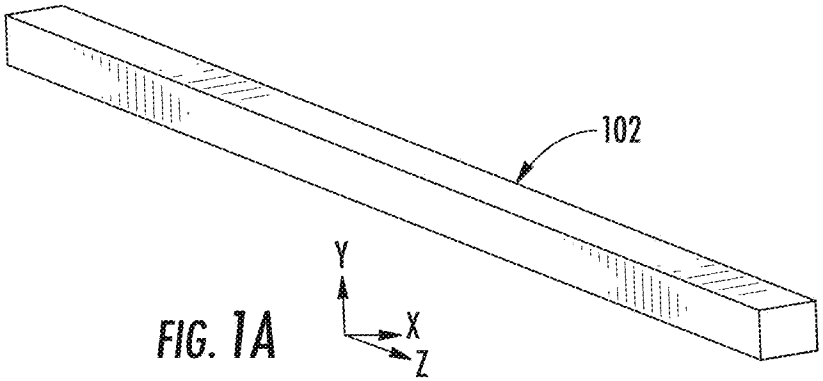
FIGS. 1A-1C represent a silicon dielectric ribbon (DRW) waveguide, the longitudinal electric field pattern on the waveguide surface, and the longitudinal electric field pattern in the transverse direction, respectively.
Figure 1B:
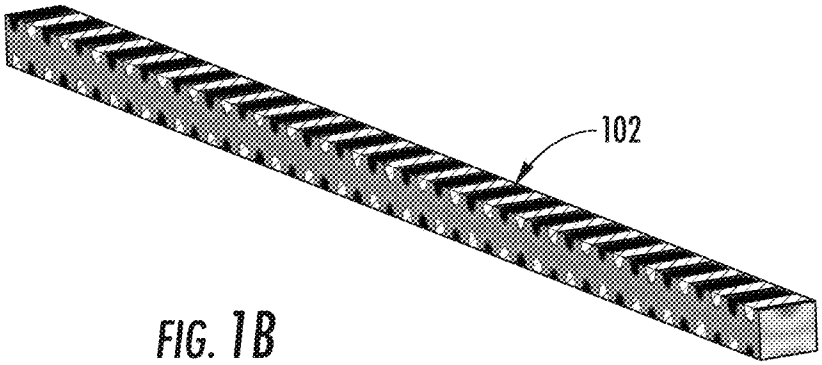
Figure 1C:
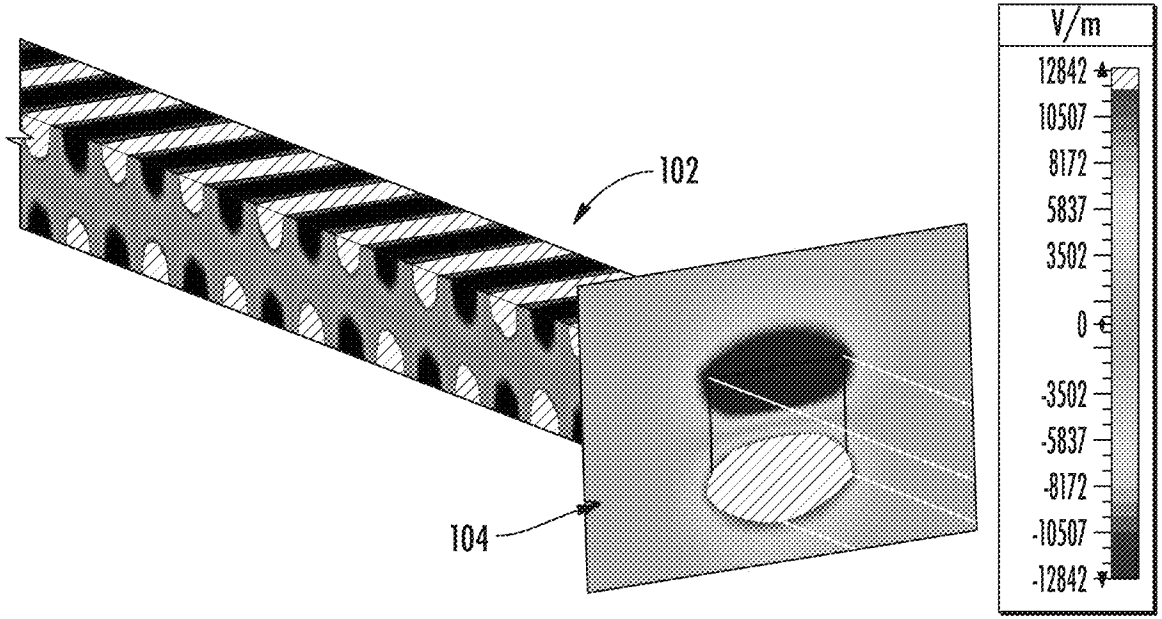

FIG. 1A depicts a dielectric ribbon waveguide (DRW) 102 micro-fabricated from silicon (Si) wafers, in one example, which is a key component of the electromagnetic (EM) circuits disclosed herein and contained within the vacuum electronic device (VED). Although Si may be preferred in some examples, other materials may also be used. In one example, as shown in FIGS. 1A-1C, the cross-sectional dimensions of the dielectric ribbon waveguide 102 may be 240 μm by 380 μm for 300 GHz working frequency and its length may be 6 cm. In another embodiment, the cross-sectional dimensions may be 120 μm by 190 μm for 600 GHz working frequency and its length may be cm. It is well-known to those skilled in the art that the dimensions of the DRW scale with the working wavelength of the VED. As a first approximation, the cross-sectional dimensions of the Si-DRW define the working frequency and the length of the DRW (relative to the wavelength)

determines relative amplification, for a given VED design. FIG. 1B shows the longitudinal electric field pattern on the waveguide surface for the first propagating mode. FIG. 1C shows that the longitudinal field of the first propagating mode extends beyond the waveguide surfaces in transversal directions.

In one example, the electric fields generated in the dielectric ribbon waveguide 102 may be generated from an electromagnetic wave introduced into the DRW 102. In another example, the electric fields generated in the dielectric ribbon waveguide 102 may be generated from noise inherent to the system.

The present invention exploits certain properties of crystal silicon (Si) and Si dielectric ribbon waveguides (DRW) to enable high frequency VED operation, namely the propagation of the electromagnetic waves within and along the Si, which may extend beyond the surfaces of the Si in some cases, to enable efficient coupling or interaction with its surroundings. Other dielectric materials, aside from Si, including doped Si, and non-Si dielectrics, with similar properties may also be suitable to enable the electric field to extend beyond the dielectric ribbon waveguide for efficient interaction with its surroundings. In another example the material may exhibit homogenous properties or inhomogeneous properties, such as by inhomogeneous doping in another example.

The use of dielectric ribbon waveguides, thus, present a number of benefits relative to conventional approaches that use Si or other wafer microfabrication techniques to obtain high precision components which are consequently fully covered with conductive metal such as Cu or Au. In these approaches, the Si plays only a mechanical or structural role, enabling the fabrication of high precision, in some cases <1 micron, components. However, the Si itself does not interact directly with the EM waves in these approaches, as it is fully-clad or coated in metal. Electromagnetically, such circuits are equivalent to full metal ones. In contrast to these approaches, the present application discloses EM circuits which exploit the beneficial properties of Si (or other similar materials) to interact directly with the EM waves, and preferentially enhance the interaction of these waves with other materials or processes in their vicinity, such as an electron beam in one example, based on unique properties of dielectric ribbon waveguides.

In certain embodiments, the dielectric ribbon waveguide is unclad. In this disclosure, the term "unclad" denotes a waveguide that is not covered, plated or coated with a material that inhibits the passage of the EM waves through the waveguide so that it may interact with an electron beam disposed proximate the waveguide. Thus, the dielectric ribbon waveguides described herein are not metallized or coated with metal.

In certain other embodiments, the dielectric ribbon waveguide may be metalized or contain a metallic coating on one or more selective surfaces to enhance internal reflections within the waveguide, or to mechanically or thermally protect a portion of the waveguide. In one example, a metallic coating may be applied only to one or both ends of the dielectric ribbon waveguide, leaving all of its other surfaces uncoated. In a further example, the metallic coating covers less then 10% of the waveguide surface area. However even in such embodiments, the dielectric ribbon waveguide also comprises substantial surfaces that are not metallized and are unclad such that the EM waves propagating within the waveguide may interact with an electron beam disposed proximate the waveguide.

The preferential properties are described below:

1. Propagating modes of Si DRW have suitable EM field patterns for efficient interaction with electron beams. First, the electric field is not confined inside the DRW, thus a mode can interact with the electron beam passing nearby, as shown in FIG. 1C. Second, the first propagating mode of the DRW has longitudinal electric fields, which is necessary for energy exchange between the electron beam and the EM signal, as shown in FIG. 1B.
2. The first propagating mode of the Si DRW exhibits a phase velocity, which can be much lower than the velocity of light. Its value depends on the cross-sectional dimensions of the DRW and the refractive index of the material that it is made of (refractive index of Si is about 3.44). In the case of Si DRW, the phase velocity can be changed from almost equal to the velocity of light in vacuum (c) in thin (relative to wavelength) DRWs, to about c/3 in thick (relative to wavelength) DRWs. Thus, slow wave circuits and resonators can be designed for resonant interaction with electron beams having the same relatively low velocities of about c/3. This velocity corresponds to 30-50 keV electron energy in one example, which is relatively low, but can be even lower in another example. Smooth changes in the transversal dimension of the DRW along its length will lead to the smooth change of the phase velocity too. Continuous adaptation of the phase velocity to the electron velocities is known as tapering. It is used in classical TWT and TWT like devices to increase beam efficiency. Si DRW EM circuits offer a simple and precise way for realization of this important feature in THz devices.
3. Thin layers of metal can be applied on Si DRWs where necessary to selective surfaces. In this manner, Si DRWs can be converted into a resonator (resonators are necessary for klystron family devices) or biased to a desired electrostatic potential. The deposition or coating of the metallization or conducting material can be local or exhibit varying properties only in specific regions of the dielectric ribbon waveguide, in some cases. In one example of a resonator, conducting materials may be deposited only on the ends of the DRW.
4. DRWs made from pure crystal Si have one of the smallest electrical losses of all materials in the THz band. Si resistivity can be as high as 20-25 kΩcm and more. In one example, single mode Si DRW with 10 kΩcm resistivity had an attenuation of about 0.05 dB/cm at 220 GHz. This attenuation is expected to be even smaller for higher frequencies and higher resistivity Si. In addition, the electrical properties, including resistivity, of Si may be modified by doping to suit specific needs of the design. The doping may be homogeneous or inhomogeneous in some cases. The conductivity may be locally enhanced by doping and may be beneficial to remove static charges from the EM circuit, or to damp unwanted EM modes, for example.
5. Crystal Si is a vacuum compatible material, has high electrostatic strength and good mechanical strength, which makes crystal Si suitable for VED applications. Silicon also has low thermal expansion coefficient ($2.56\times 10^{-6}$ $K^{-1}$). This makes it particularly suitable for THz band because otherwise even small thermal expansion can drastically change the electromagnetic properties of THz components.
6. Modern micro-fabrication and wafer processing techniques utilizing Si wafers provide great flexibility in geometry and provide the precision necessary for THz band EM components, which overcomes limitations of traditional micro-machining techniques applied to metallic parts.

Although the above list refers to the use of Si, any suitable dielectric material may be used, which may exhibit similar beneficial properties to those listed above. In one example materials with low loss and high refractive index may be preferred. GaAs is one example of a material which may be suitable.

Table 1 provides suitable ranges for several key material properties important for the selection of materials for use in dielectric ribbon waveguides. Examples of materials exhibiting these properties include gallium nitride, silicon carbide, indium gallium arsenide, and graphene, among others.

TABLE 1

Main material properties necessary for DRW like circuits to be suitable in THz VEDs.

| Material property | Range | Note |
|---|---|---|
| Refractive index | >2.0 | The higher refractive index - the lower electron beam energy needed. Materials with refractive index < 2 would require sub relativistic electron beams which are technologically challenging. |
| Resistivity | >5.0 kOhm * cm | Lower resistivity would lead to losses comparable with metal EM circuits. Thus, invalidating one of the advantages of DRW approach. All the examples in this disclosure assume resistivity to be 10.0-20.0 kOhm * cm. |
| Vacuum Compatibility | Ultra-high vacuum rated | Low outgassing is essential for any VED material. |
| Suitability for Microfabrication | <5.0-micron precision fabrication methods exist for this material | Even higher precision may be needed for above 1.0 THz DRW VEDs. |
| Thermally stable | Preferably has thermally stable electromagnetic and mechanical properties | Most of VEDs heats up during operation. |

Additional properties, not listed in Table 1, may be required depending on a given VED design.

FIGS. 1B and 1C illustrate the longitudinal electric field pattern of the first propagating mode. This has two important and useful properties:

1. Maxima of the longitudinal electric field are located at the surfaces of the DRW and not inside the guide.
2. Longitudinal electric fields extend outside of the DRW (see transversal distribution 104).

With such field patterns, an electron beam (not shown), passing close to the upper DRW surface, for example, can efficiently interact with the first propagating mode of the DRW. Thus, the DRW arrangements can provide a very flexible and simple framework for high efficiency beam-wave interactions. These interactions are at the basis of any VED, enabling different types of VEDs such as klystrons, traveling wave tubes (TWT), enhanced interaction oscillators (EIO) and their variants to be built around the DRWs. Some VEDs may serve to amplify existing radio frequency or THz signals and other VEDs may serve to generate the radio frequency or THz signals. In general klystrons, TWT devices can serve as either amplifiers or signal generators. In the case of an amplifier, the amplified signal is supplied externally. In the case of a signal generator, an external signal may be supplied to start the circuit, such as to start or initiate the oscillations in one example, or the oscillations may be initiated from noise inherent to the system. Oscillators, on the other hand, such as enhanced interaction oscillators or magnetrons, operate only as signal generators. In a preferred embodiment, the DRW may be constructed from Si. In another embodiment, a different dielectric material may be used, and in yet another embodiment, the DRW may be a combination of Si and other suitable materials.

One particularly important benefit of Si DRWs is the fact that the propagation of the EM waves occurs through dielectric material (and on its surface) as opposed to being confined within a conducting structure such as in a traditional metallic waveguide, or cavity, (whether machined or metal-plated) thereby significantly increasing the coupling efficiency between the DRW and an adjacent electron beam.

EXAMPLES

Example 1. Klystron with Si DRW Buncher and Catcher

Figure 2B:
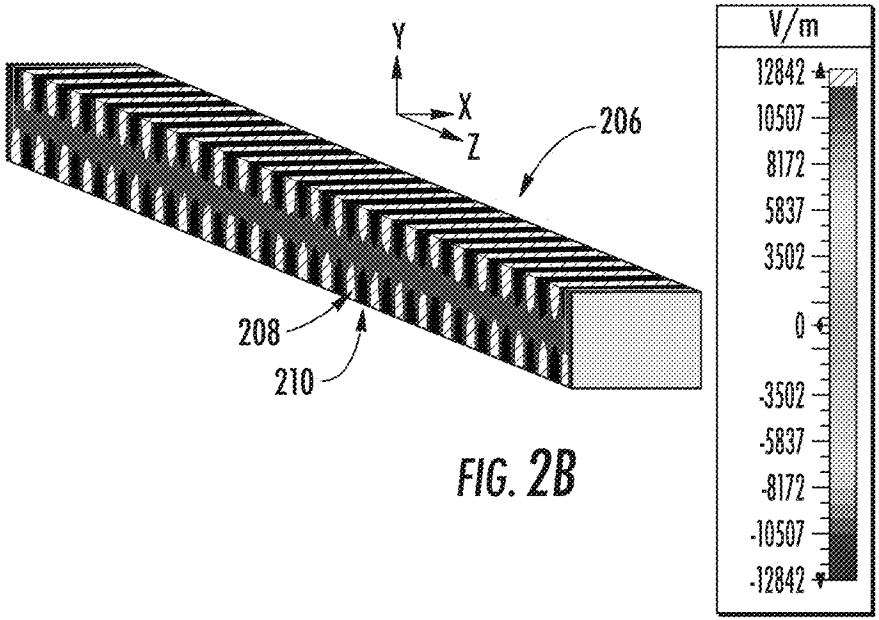
FIGS. 2A-2B represent a silicon dielectric ribbon resonator and the longitudinal electrical field pattern of the standing wave, respectively.
Figure 2A:
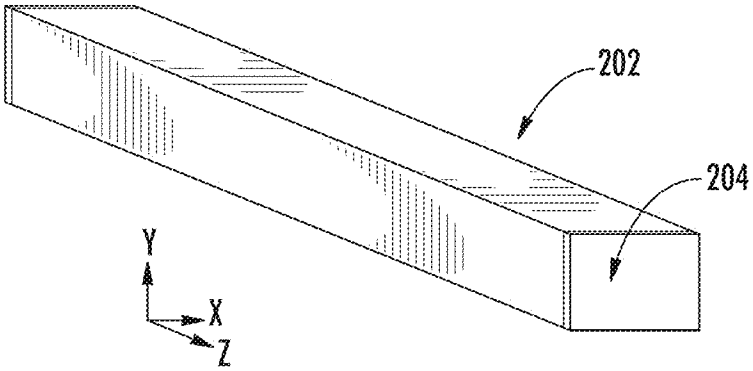

FIG. 2A illustrates a section of the DRW 202 utilized as a resonator by application of metallization 204 selectively on its ends. The metallization may be applied by conventional vapor deposition, sputter coating or other means. Suitable materials for the metallization include, copper or gold, among others. In one example, the metallization 204 is applied only to one end of DRW 202 and in another example, metallization 204 is applied to both ends of DRW 202 leaving all of the sides and all other surfaces of DRW 202 not coated in metal.

FIG. 2B shows a standing wave 206 excited within the resonator formed by DRW 202 and metallization of its ends 204. Standing wave 206 comprises alternating regions of high electric field strength [V/m] 208 and regions of low electric field strength 210. The standing wave 206 is visible in FIG. 2B and is strongest on the top and bottom surfaces of the DRW 202.

In one example, having an electric field concentrated around the perimeter of the DRW 202 is preferential as it increases the interaction with an electron beam passing near DRW 202. In this manner, the efficiency of energy transfer may be increased. Extending the electric field beyond the physical boundary (surfaces) of the DRW 202 is an important advantage of this approach relative to metallic structures, (whether machined or fully plated or metalized), since metal or conductive structures effectively prevent or shield the EM wave from extending beyond its surface in the case of a metallic waveguide. In this manner, DRW 202 enables highly efficient coupling or interaction between the wave propagating on the DRW and an adjacent or nearby electron beam in one example, or another DRW in another example.

In yet another example, the properties of the interior surface of the DRW 202 and end terminations 204 may be controlled to preferentially influence the local electric field such as by modifying its physical properties, including surface roughness in one example, and conductivity in another example, or by the addition of geometric features in yet another example. Modifications to DRW 202 may be local and affect only the electric field on one or more spatial regions located within DRW 202 or may be global and affect the entire DRW 202. In another example, lossy, partially reflective, or absorbing material may be applied to specific regions within DRW 202 to damp the electromagnetic waves in specific regions.

Figure 3A:
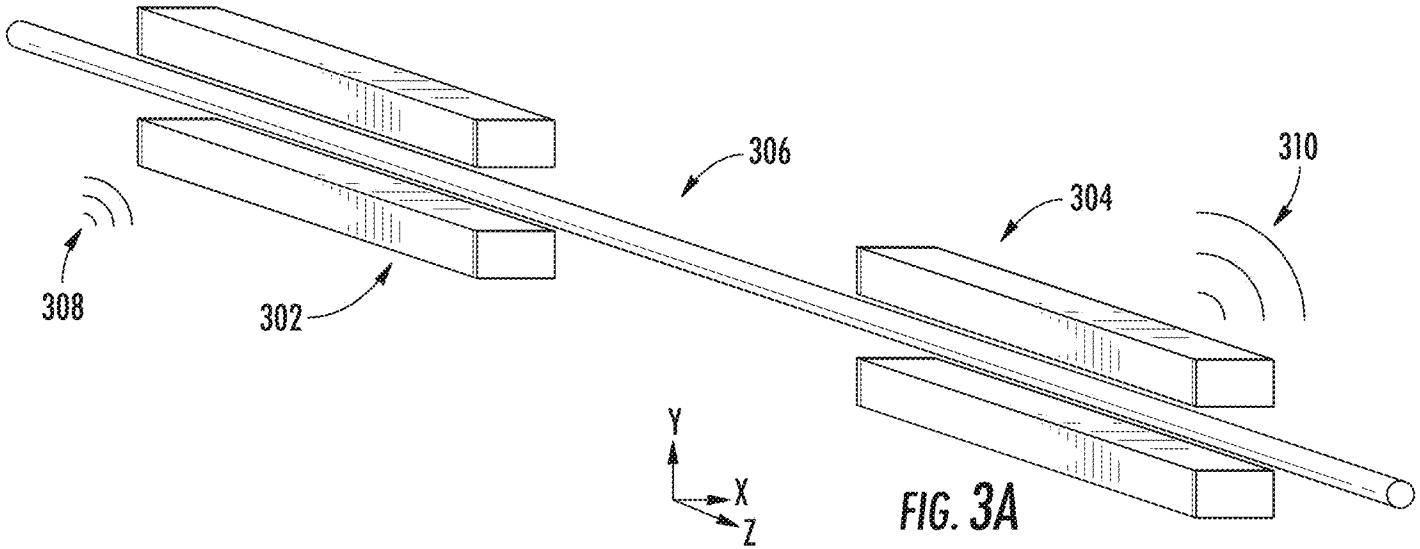
FIGS. 3A-3B represents one example of a THz klystron and the longitudinal electric field, respectively.
Figure 3B:
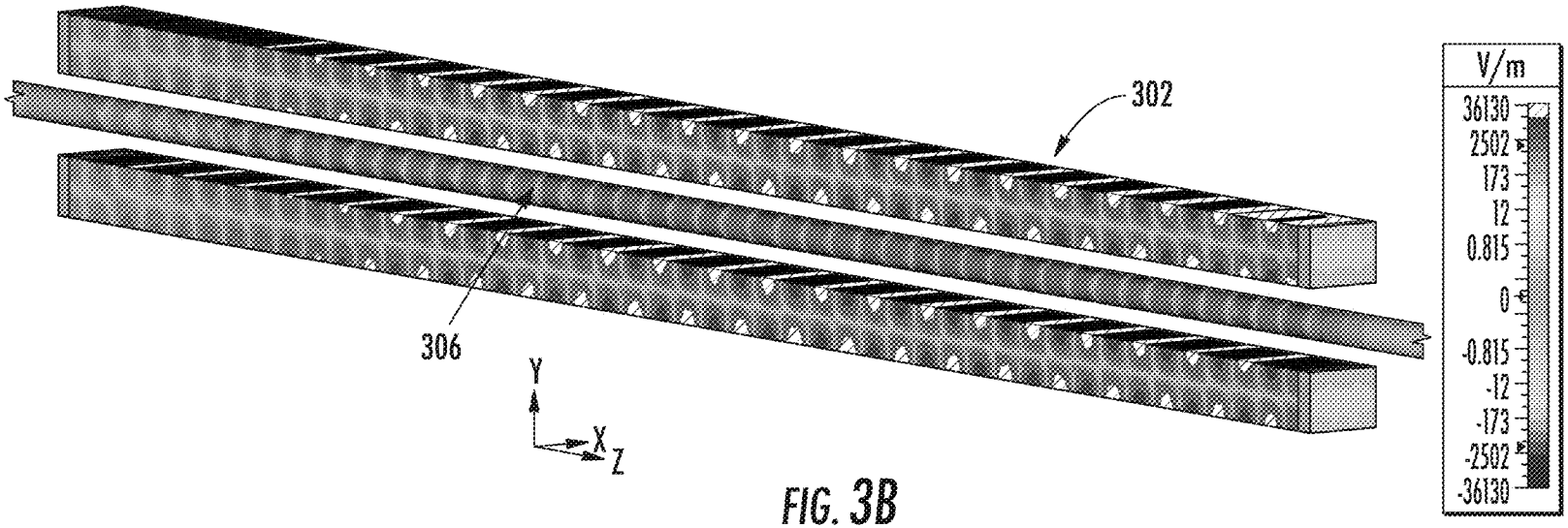

The resonators shown in FIG. 2A may be combined to form a buncher 302 and a catcher 304 of a klystron, in one example, as shown in FIG. 3A. The figure further shows an electron beam 306 passing through the buncher 302 and catcher 304. The buncher 302 and a catcher 304 are shown with DRW pairs, one on each side of electron beam 306 in FIG. 3A. In one example, the distance between the DRW pairs may be approximately twice the diameter of the electron beam passing between them. In a particular example, the electron beam diameter may be 100 μm and the distance between the DRW pairs may be 200 μm. In general, the smaller the distance between the electron beam and DRW, the better the interaction between the beam and DRW. An input EM wave 308 is symbolically shown as input to buncher 302 and an output EM wave 310 is symbolically shown as output from catcher 304. In the case of an amplifier, input EM wave 308 may be used and in the case of a signal generator, input EM wave 308 may not be used. FIG. 3B shows the longitudinal electric field distribution of the standing wave in the buncher 302 and in the electron beam 306.

The electron beam 306 may be generated from any number of sources including electron guns, both thermally-assisted and cold electron guns. In one example, the source of the electron beam 306 may be a cathode ray tube (CRT) like electron gun. Any suitable electron beam source may be used.

In one example, the electron beam diameter may be approximately 100 μm near the buncher 302 and less than 300 μm near the catcher 304. In one example, the electron beam 306 may be diverging as long as it does not contact directly the DRW walls such as the buncher 302 or catcher 304 or the drift space formed by the region between them as shown in FIG. 3A. In a particular embodiment, the distance between the buncher 302 and catcher 304 may range from 4 cm to 10 cm, although any suitable distance may be used. In another example, the electron beam 306 may be collimated. In one example, permanent magnets or solenoids may be used to focus the electron beam 306 and minimize divergence. In another example, no additional means of focusing the beam may be used. In yet another example, the electron beam 306 may contact the DRW walls so long as the contact does not damage the DRW or degrade the performance of the system.

In a preferred embodiment, the electron beam 306 power may be around 10 W. In a particular example, the beam current may range from 0.2 to 1 mA and the voltage may range from 30 kV to 50 kV. However, any suitable beam current and voltage may be used. In one example, the electron beam 306 power may be variable, and in another example, it may be fixed.

The configuration shown in FIG. 3A further improves the electric field pattern of the single Si DRW resonator at the location of the electron beam 306 passing through buncher 302 and catcher 304. The arrangement of two Si DRW resonators side by side increases the longitudinal component of the electric field and decreases its transversal components, as shown in FIG. 3B. The longitudinal component of the field is responsible for efficient power exchange between the electron beam and the EM wave (higher beam efficiency) and must be maximized at the beam location. At the same time, the transversal components can deviate or disperse the beam and must be reduced at the beam location. In the present arrangement, at the beam center, only the longitudinal (useful) component is present. This configuration therefore results in high efficiency energy transfer between the electron beam 306 and the electromagnetic waves in the electromagnetic circuit comprised of buncher 302 and catcher 304. Arrangements of three, four or more Si DRW resonators around the electron beam axis is also possible to build bunchers and catchers with EM fields optimized for a given design.

The advantages of the DRW resonators approach illustrated in FIG. 3A enables the extension of conventional klystrons to the THz frequency range. It overcomes many of the limitations of low efficiency designs, characteristic of conventional approaches, by means of the longitudinal electric field distribution extending beyond the DRW surfaces and increased interaction with the electron beam utilizing this DRW approach.

The key components required for the electromagnetic circuit, namely the buncher 302 and catcher 304 may be fabricated with small feature sizes and a high degree of dimensional accuracy by applying semiconductor wafer processing techniques combined with microfabrication approaches to develop DRWs with the dimensional tolerances on the order of <1 um, in one example. Deep reactive ion etching is one approach, among others, which may be used to fabricate the components.

Two unique aspects of the klystron designs disclosed above are the buncher and catcher, which are built from Si DRW standing wave resonators instead of metal cavities, typical in classical low frequency klystrons. This design results in a unique longitudinal electric field distribution along the length of the DRW which solves the problem of electrical breakdowns and arcing inside THz klystrons. The operation of this klystron for purposes of signal amplification is as follows:

1. A standing wave of low power is excited in the buncher 302 by an external low power radio frequency (RF) source (not shown in the figure) with the signal or input EM wave 308 to be amplified. The external frequency source may be an oscillator, such as a voltage-controlled oscillator in one example, with or without amplification. Other sources, such as synthesizers or laser sources, and others may also be used to generate the input signal.
2. The electron beam 306 with the electron velocity which is equal to the phase velocity of the standing wave interacts with the standing wave as described in reference to FIG. 3A above. One example of the longitudinal field of the standing wave in the buncher 302 comprised of two Si DRW resonators is shown in FIG. 3B.
3. Because the electron velocity is equal to the phase velocity, half of the electrons inside the buncher 302 are subjected to an accelerating electric field and the other half are subjected to a decelerating electric field. This effect results in modulation of the electron velocities within the buncher 302.
4. The path between the buncher 302 and catcher 304 is known as the drift space. When passing through the drift space, faster electrons catch up with the slower electrons and create bunches of electrons. It should be noted that the drift space often makes up most of the total length of the klystron. In some cases, it is desirable to shorten the length of the drift space to minimize the divergence of the electron beam, in which case the modulation voltage of the buncher 302 should be as high as possible.
5. At the catcher 304 location, bunches of electrons arrive after passing through the drift space. This results in the DC electron beam current becoming a high frequency, high power AC current. Interaction of this current with catcher 304, which is a type of a resonator, tuned to AC current frequency, excites a standing wave of high amplitude in the catcher 304. The power from this standing wave or output EM wave 310 can be fed to an antenna or to another waveguide (not shown on the figure) to transfer the generated electromagnetic wave out from the catcher.

In one example, a feedback path (not shown) from the catcher 304 to the buncher 302 may be configured to enable the SI DRW klystron to work as a signal generator. In another example, an external reference signal may be utilized to start the circuit, such as input EM wave 308 generated from a low power semiconductor-based oscillator in one example. In another example, an external reference signal may not be utilized, and the THz signal may be generated from the noise inherent to the klystron. The generated signal can be radiated by an antenna, or fed to any other output, such as waveguide for example.

Example 2. TWT with Si DRW Slow Wave Circuit

Traveling wave tubes (TWT) are based on the phenomenon of enhanced interaction between the EM wave and an electron beam traveling in the same direction and with almost the same velocity. Electron velocity is always less than the speed of light and there are often engineering advantages to have it as low as possible to use lower energy electron beams. To make the electromagnetic wave inside a TWT travel with a velocity less than the speed of light, slow wave circuits are used. Efficient slow wave circuits are advantageous to reduce the physical length or size of the components, which enables improved dimensional control, which is particularly important at high frequencies. When the electron velocity is slightly higher than the wave phase velocity inside a slow wave circuit, kinetic energy from the electrons is transferred to the EM wave. In this manner, amplification of the EM wave takes place along the length of the slow wave circuit.

Figure 4A:
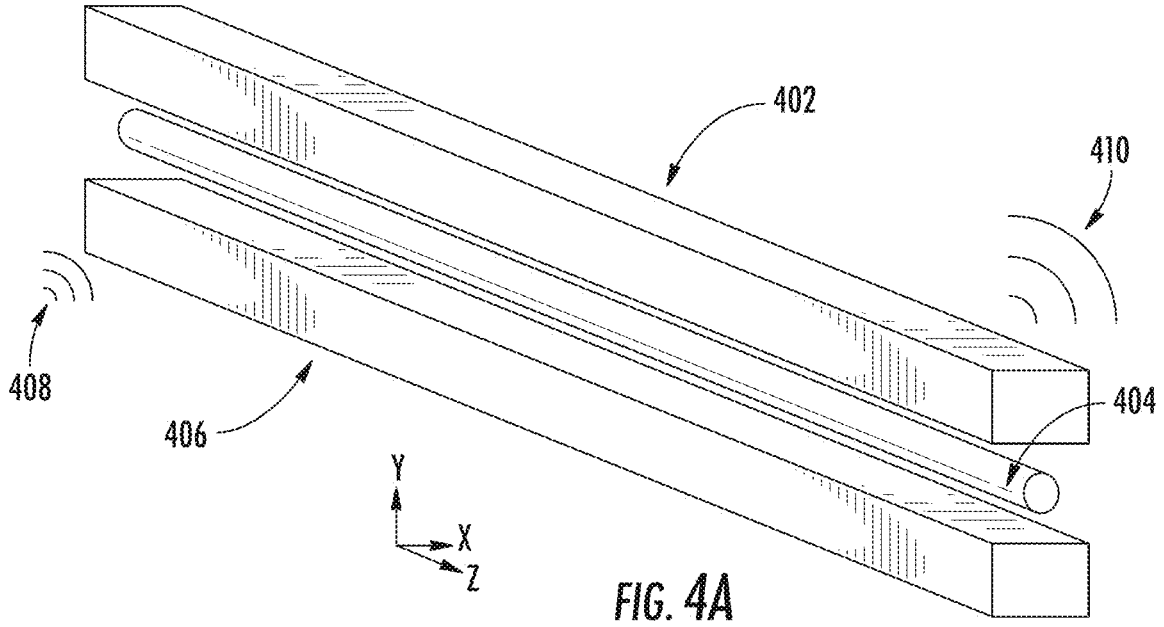
FIGS. 4A-4B represent one example of a THz TWT and the longitudinal electric field, respectively.
Figure 4B:
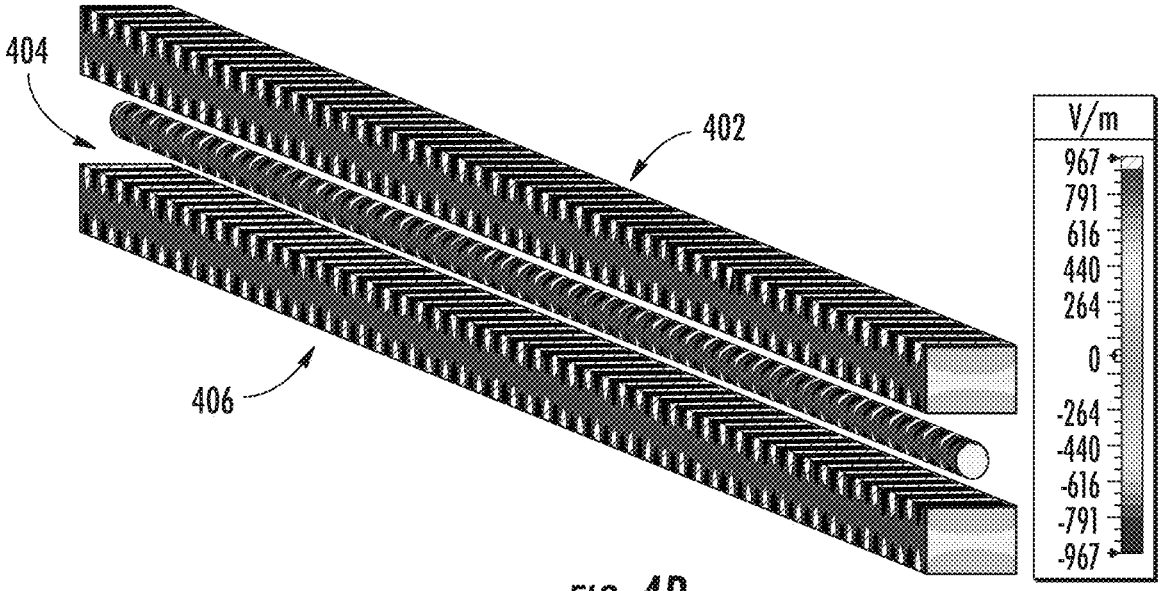

In contrast to conventional TWT approaches, the TWT disclosed herein is based on a Si DRW slow wave circuit shown in FIG. 4A. Input EM wave 408 may be input to DRW 406 or 402 and output EM wave 410 may be output from the opposite end (relative to input EM wave 408) of DRW 406 or 402. Input EM wave 408 may or may not be used. The arrangement of two DRWs 402 and 406 increase the longitudinal component of the electric field and decrease its transverse components at the electron beam 404 location. At the electron beam 404 center, only the longitudinal (useful) component of the electric field is present. FIG. 4B further shows the electric field distribution [V/m] in the electron beam 404 and on the DRWs 402 and 406.

In one example, DRW 406 or DRW 402 does not contain any metalized surfaces. In another example, the ends on the left side of DRW 406 and DRW 402 may be metallized (not shown).

Another distinguishing aspect of Si DRWs is that they can be designed to have low phase velocity. For example, the phase velocity of the first propagating mode can be reduced down to one third of the velocity of light by changing the transversal dimensions of the DRW. For example, a circuit of the TWT shown in FIG. 4A made from 240 μm×380 um Si DRWs has the phase velocity about c/(2.5) at 300 GHz. Increasing the transversal dimensions to 300 μm×380 μm, for example, would give a phase velocity of the first propagating mode about c/(3.3). However, continuing to increase the transversal dimensions will lead to second propagation mode domination of the field pattern, which is not suitable for efficient wave beam interaction in this example. Thus, phase velocities of about c/3-c/2.5 are optimal in one example. These relatively low phase velocities allow a design of the TWT with the electron beams having 30 keV-50 keV energy, in one embodiment. In another example, even lower energy beams may be suitable. Use of low energy electron beams is desirable to minimize anode voltage, reduce complexity of the electron focusing system, and minimize power consumption and heat generation.

It is known that Si DRWs are frequency dispersive. This means that in a given Si DRW the phase velocity (V_p) of any mode depends on frequency (f)

$$V_p = V_p(f) \quad \text{(Equation 1)}$$

Thus, an electron beam with a given velocity will excite only a wave with approximately the same phase velocity and fixed frequency (or narrow band of frequencies). The electron velocity can be controlled by the anode voltage and therefore the working frequency of the Si DRW TWTs is also controlled by the anode voltage.

In one example, the slow wave circuit shown in FIG. 4A may be used as an amplifier. In this case, a small amplitude input EM wave 408 from any suitable low power THz source (not shown), may enter slow wave circuit as shown in FIG. 4A at the left and will exit the circuit amplified at the right as output EM wave 410. Signal amplification is one common use of TWTs. However, if an external feedback path is provided, whereby the feedback sends part of the output signal back to the input, then the TWT may be used as signal generator. No feedback circuits are shown on FIG. 4A, but an example is provided in reference to FIG. 9B. In one example, the feedback can be external to the vacuum envelope and based on metal waveguides. In another example the feedback path can be a DRW and be inside a vacuum envelope.

In many terahertz applications, tuning or sweeping the frequency of the output signal frequency is important. The ability, (enabled by the dispersion of the Si DRW waveguide) to vary and control the working frequency by changing the anode voltage (without mechanical tuning) is another advantage of Si DRW TWTs. In one example, a control unit, such as an analog control unit or digital control unit may be used to vary the anode voltage and modify the working frequency. In other applications, the working frequency may be fixed.

Example 3. Loop TWT

It is known that in TWTs, the power gain (in dB) per unit length is proportional to the slow wave circuit impedance at the electron beam location. Usually, in classic TWTs, the electron beam passes at the location of the maximal wave impedance (usually maximal longitudinal electric field) inside the slow wave circuit. This allows maximization of the gain. In the case of THz TWTs, this maximization is difficult or impossible to realize. The electron beam is wide compared to the wavelength and inevitably, a large part of the beam does not see the maximal wave impedance. Thus, the equivalent wave impedances of THz TWTs are usually much lower than for kHz-GHz TWTs, and comparable high beam efficiency (~50%) and high power gain are difficult or impossible to achieve.

Figure 5B:
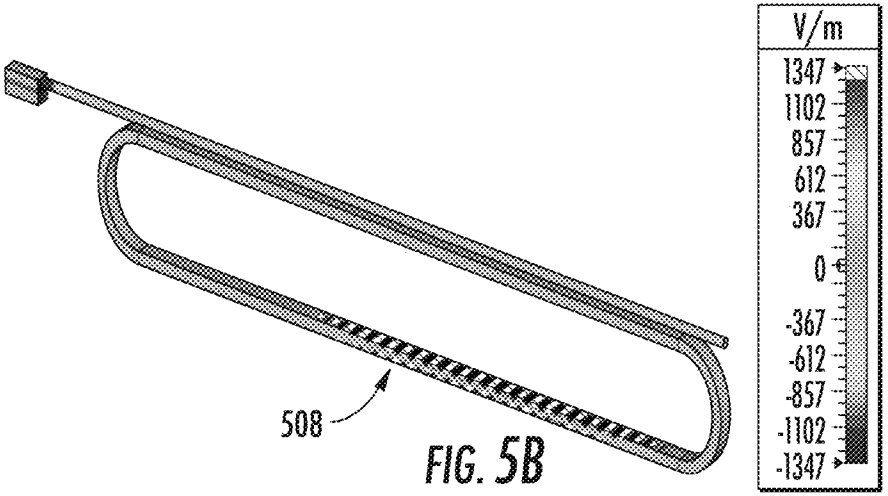
FIGS. 5A-5C represent one example of a THz loop TWT, the wave train on the loop and the wave train amplification after 16 rounds, respectively.
Figure 5A:
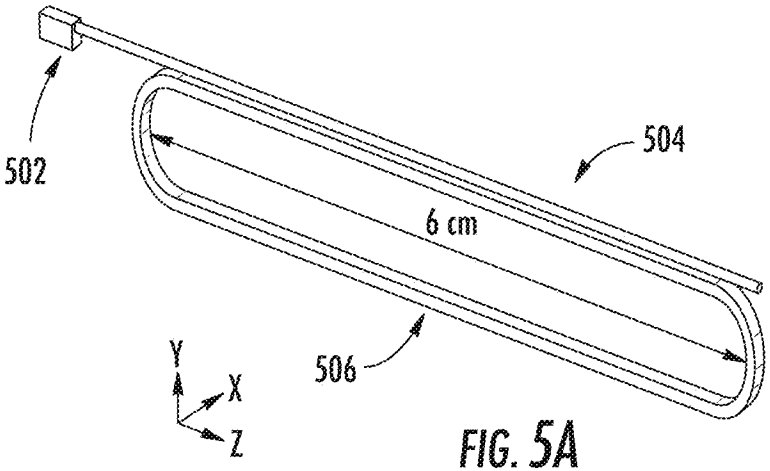

FIG. 5A shows one embodiment of a loop TWT, which overcomes the problem of low wave impedance, low beam efficiency and low gain in the existing THz TWTs.

FIG. 5A shows a loop TWT containing an electron gun 502, electron beam 504 and Si DRW loop or resonator 506.

The loop can be microfabricated from a Si wafer by deep reactive ion etching process, in one example. In another example, loop 506 is cut or etched from a single Si wafer. In yet another example, multiple loops may be cut from a single wafer. The electron gun 502 may be any suitable electron gun. In one example, electron gun 502 may be a CRT-like gun. In another example, electron gun 502 may be a Pierce gun. The initial wave train 508 can be induced in the Si DRW loop 506, as shown in FIG. 5B by noise inherent in the loop 506 or the initial wave train 508 may be generated by an external low power THz source and fed into the loop 506. In one example where an external source is used, a low power semiconductor THz source may be used, such as a Gunn diode. In another example, a low power EM impulse generated by femtosecond laser can be used. Any other types of suitable sources may also be used. In yet another example, the source may utilize a voltage-controlled oscillator and amplifier and/or multiplier chain. Other types of sources may also be used.

Figure 5C:
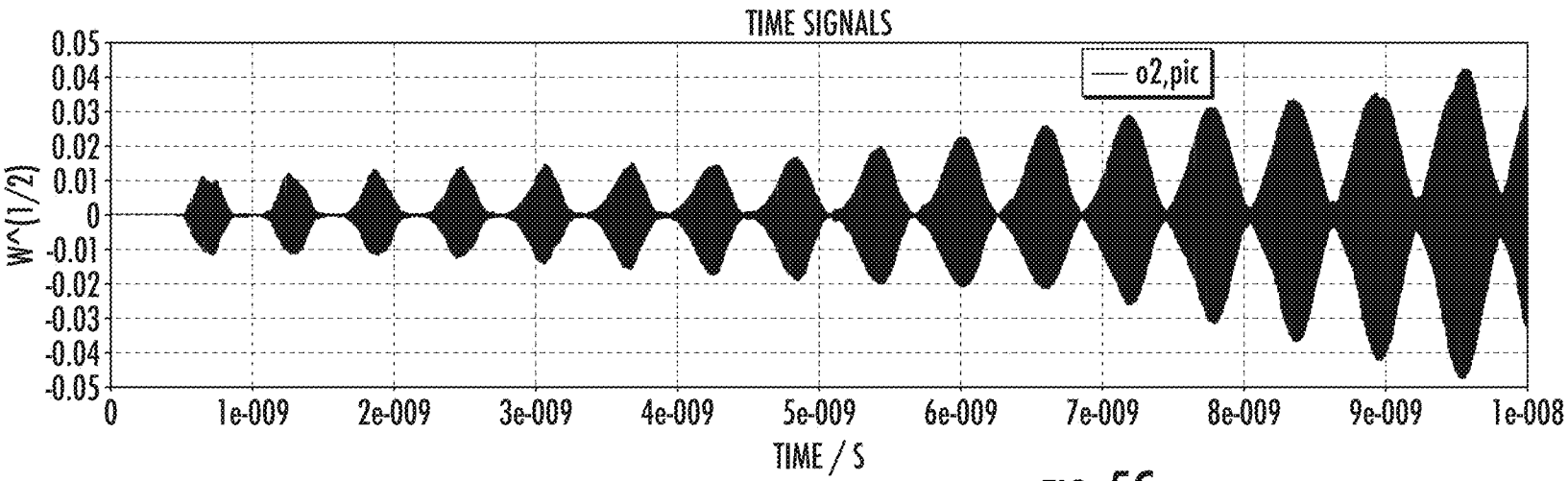

The wave train 508 travels around the loop 506 almost without losses if the loop 506 is made of high resistive Si, or similar low-loss dielectric material as indicated in Table 1. Every time the wave train 508 passes by the electron beam 504, wave amplification takes place as in a linear TWT. In practice, some power of the wave train 508 may be also lost each round due to ohmic and radiative losses. However, if losses are smaller than the amplification, every pass around the loop 506, the wave train 508 receives a net power gain. Even if the amplification due to one complete pass around the loop 506 is very low (slightly higher than 1), after a certain number of iterations, a significant amplification of the initial wave amplitude takes place as illustrated in FIG. 5C.

This amplification cycle will continue until the system reaches saturation and destroys the coherent beam-wave interaction. This may occur when the power of the wave is around 50% of the beam power, meaning that beam efficiency of the loop TWT may be as high as 50%. One example illustrated in FIG. 5C indicates that every iteration around the loop 506 the signal is amplified by approximately 1.1 times, but after 16 rounds the signal is amplified by a factor of 4, as shown in FIG. 5C.

An illustrative calculation shows that for 30 dB power gain about 40 iterations are necessary with the loop TWT shown in FIG. 5A. To obtain 30 dB power gain with a similar linear TWT, its length must be about 40 times longer. Taking as an example a 300 GHz system, a linear TWT with a slow wave circuit of 1-2 meters with micron-level precision in the transversal direction must be fabricated. This would be extremely difficult or impossible to realize in practice. On the contrary, the loop TWT design allows for a high gain and high efficiency slow wave circuit to be fabricated from standard 3-4 inch Si wafers. In one example, the loop 506 may be 6 cm long with a radius of 1 cm and cross-sectional dimensions of 240 μm×380 μm. In another example, an assembly of two Si DRW loops can be used to maximize the longitudinal electric field at the electron beam location similar to the configuration shown in the FIG. 4A. This can be achieved by stacking two loops made from different wafers one upon the other with the necessary gap for the electron beam in between them.

Loop TWTs overcome the low beam efficiency of existing THz VEDs (usually around 1%) and can reach 50% beam efficiency in the THz band. This is because of the loop configuration of the slow wave circuit and repetitive THz signal amplification every time it passes by the electron beam 504.

In classical TWTs, the slow wave circuit is linear. This can be a long helix or a line of many coupled cavities. In these classical devices, amplification depends on the length of the circuit and the wave impedance (amongst other factors). At kHz-to-GHz bands, the wave impedance can be maximized, thus, the length can be made relatively short, providing up to 30 dB power gain. In the THz band, this maximization is often impossible to obtain because the diameter of the electron beam is wide and usually only a small part of the beam sees the maximal wave impedance. In the loop TWT described in FIG. 5A, the amplification (A) of the wave train after one round can be as low as several percent. This value would be ridiculously small for a classical linear TWT, but in the loop TWT this amplification will repeat itself many times. After n rounds total amplification T is:

$$T=A^n \quad \text{(Equation 2)}$$

This amplification will be stopped by saturation, which usually happens when about 50% of beam power is converted to the EM power. In one example, a loop TWT as shown in FIG. 5A working at 300 GHz, with a beam current of 0.2 mA, anode voltage of 45 kV, beam power of 9 W, and beam diameter 0.2 mm can generate up to about 4 W at 300 GHz. This is a formidable device, going far beyond existing THz devices. Thus, loop TWTs enable efficient THz generation up to 1 THz and more. In one example, the lower part of the loop may be considered as a kind of a feedback path.

Example 4. Full THz VED Assembly

Figure 6C:
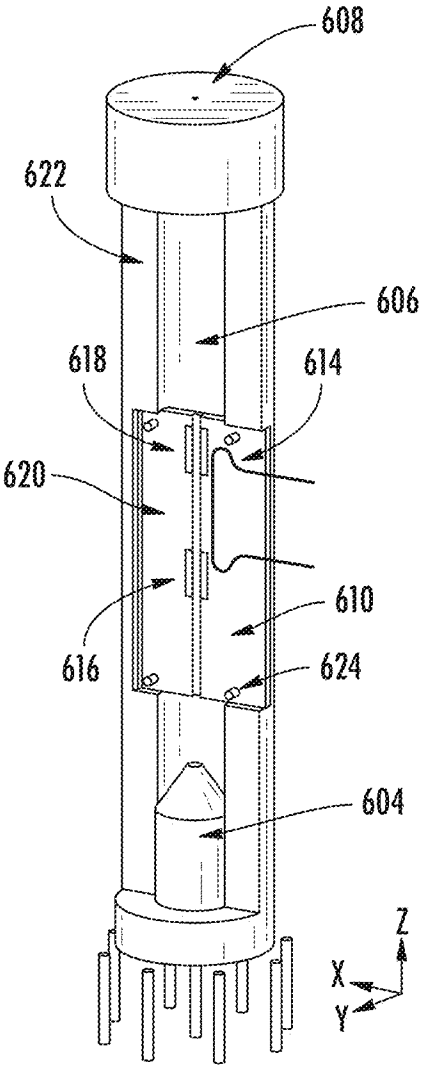
FIGS. 6A-6C represent a THz VED inside a glass tube, a loop TWT with the glass tube removed, and a klystron with the glass tube removed, respectively.
Figure 6B:
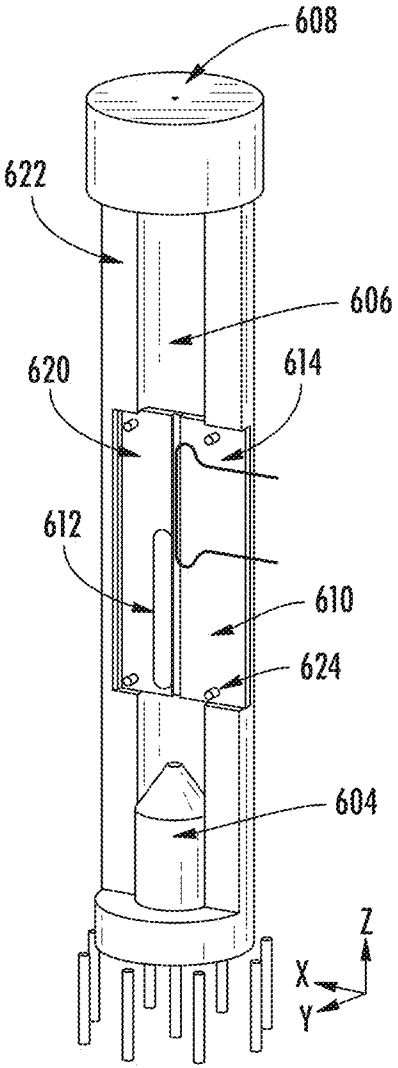
Figure 6A:
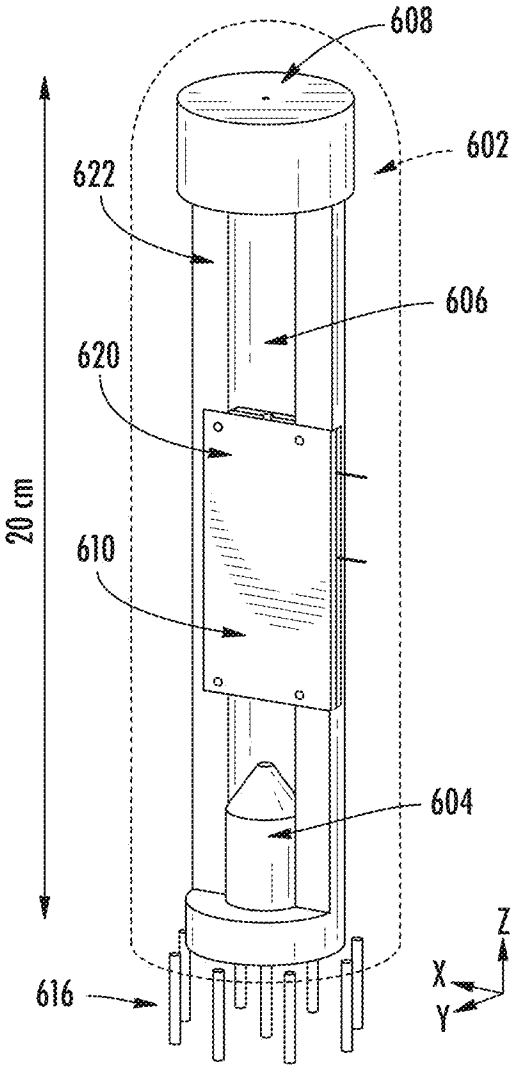

One example of a complete THz VED assembled inside a glass tube is shown in FIG. 6A. Although a glass tube is shown as an example, any other vacuum tight housing can be used. This include housings made of metals, ceramics, or vacuum compatible plastics and the like. For lower power THz VEDs, vacuum sealing directly on the Si wafer packages based on MEMS technology may be used.

The VED assembly contains a glass tube 602 or any suitable housing capable of maintaining vacuum. In one example, vacuum levels typical for VEDs may be about 130 μPa, $1.3\times10^{-9}$ atm. An electron gun 604, electron beam 606, collector 608, and an EM circuit 610 are also shown. The electron beam 606 is shown passing through the EM circuit 610 assembly which also contains a circuit holder 620. A standard set of electrodes (such as pins, or blade terminals) 616 for the electron gun 604 power supply and controls are also shown schematically.

One important aspect of the VED shown in FIG. 6A is the alignment of the EM circuit assembly 610 with respect to the electron beam 606. The support structure 622 may be a single component in one example to facilitate alignment of the electron beam 606 with the EM circuit assembly 610 and circuit holder 620. The support structure 622 may be fabricated from a suitable vacuum compatible material to minimize outgassing. Alignment pins 624 (see FIG. 6C) are also provided to secure the EM circuit assembly 610 to the support structure 622 and align the EM circuit assembly 610 with the electron beam 606. In one example, the aperture of the EM circuit assembly 610 may be 300 μm or less. The electron beam 606 position may also be adjusted by a beam control system (not shown) based on electric and/or magnetic static fields.

FIG. 6B depicts a loop TWT which also shows further details of the EM circuit assembly 610 comprising a circuit holder 620, an amplification loop 612 and feeder 614. The role of the feeder 614, which is a type of directional coupler, is to couple an external low power THz signal (if necessary to start the generation) to the loop 612 and to couple the generated high power signal out of the device. The role of the circuit holder 620 is to hold all parts of the electromagnetic circuit together, providing additional mechanical strength, and enable precise placement of each component with respect to the electron beam. The circuit holder 620 can be made of vacuum compatible dielectrics with small losses in THz band such as ceramics, Teflon, glass, silicon, or any other suitable material.

FIG. 6C shows a klystron VED, including buncher 616 and catcher 618 and feeder loop 614 contained on a circuit holder 620 comprising an EM circuit assembly 610. The feeder 614, which is a type of directional coupler, serves to couple an external input signal to the buncher 616 and transfer the amplified signal from the catcher 618 outside the device. Any suitable external low power THz source can be in principle used. In one example, this may be a semiconductor THz source; in another example, the source can be an output of the THz antenna which captured a THz signal from the space.

In order to facilitate input and output of the THz signal from the VED, the signal must be transmitted through the housing assembly 602 shown in FIG. 6A. The transmission of the input and output signals inside the vacuum housing can be made by existing methods based on vacuum tight wave guides or coaxial cables. In one example, the connection between Si DRW and a rectangular waveguide may be realized by suitable tapering of the DRW and insertion of tapered end into a rectangular waveguide. In another example, a high frequency coaxial cable may also be used, or a suitable microstrip. In one example, the low power THz source may be a semiconductor source, such as a Gunn diode in one specific example. In another example, the source may utilize a voltage-controlled oscillator and amplifier and/or multiplier chain. Other types of sources may also be used. Alternatively, the signals can be radiated across the transparent wall or window with specially designed antennas and feedthroughs.

Figure 7:
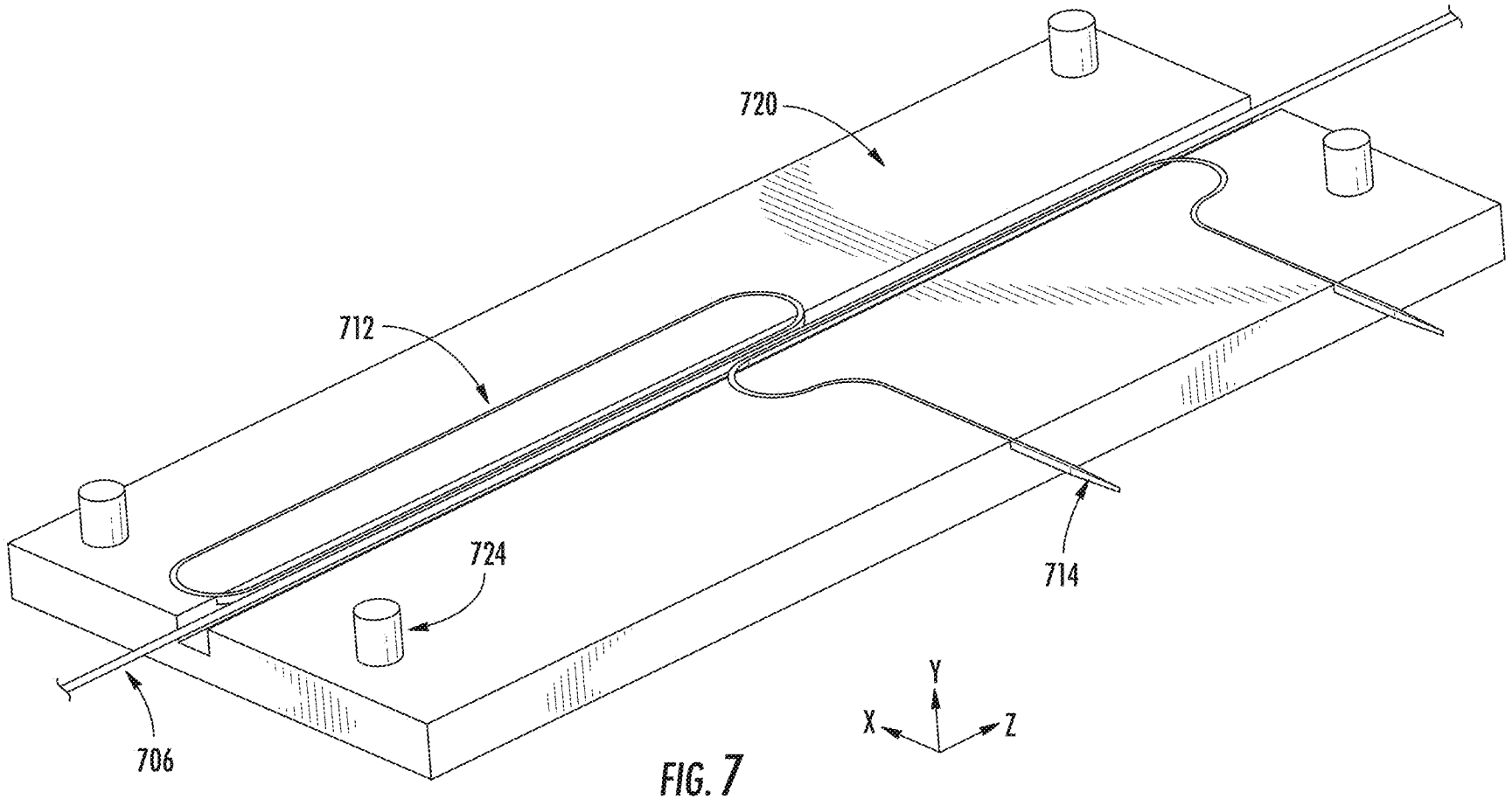
FIG. 7 represents a loop TWT EM circuit on a holder or support structure.

FIG. 7 presents the details of a loop TWT electromagnetic circuit used as signal generator mounted on a holder 720 corresponding to a particular example of the EM circuit assembly 610 shown in FIG. 6A. The holder 720 may be Teflon or any other suitable material. The initial low power wave train is coupled to the amplification loop 712 by feeder 714. Feeder 714 may receive radio frequency energy from an external source such as an oscillator or diode-based source in one example. The external source may be coupled to feeder 714 via a conventional waveguide, coax, or antenna. Initial low power wave train can be also generated by the noise inside the loop and/or e-beam in another example. While traveling around the amplification loop 712, the THz wave train gains power from electron beam 706. During each iteration around the amplification loop 712, the power of the wave train increases and is partly coupled back to the feeder 714 and then transmitted outside the VED. Pin guides 724 are used for the alignment with electron beam and for fixing the circuit inside a VED.

The pathways in the holder 720 for the electron beam path and Si DRW components 712 and 714 may be fabricated using micromachining techniques, molding processes, other means in one example. In another example, holder 720 may not be used and other suitable means of fixturing to amplification loop 712 and feeder 714 relative to electron beam 706 may be used.

FIGS. 8A-8D present the details of a klystron used as an amplifier fabricated from several layers of a silicon wafer stack, to form an electromagnetic circuit with electron beam 828 passing through it. The klystron contains several layers of wafers in this example, including one wafer layer containing the buncher 816 and catcher 818, one wafer layer containing the feeder 814 which feeds power to buncher 816 and receives the amplified power from catcher 818. The feeder 814, buncher 816, and catcher 818 are assembled and aligned with the use of other Si parts 801. Parts 801 play the role of a mechanical support and are electromagnetically disconnected by vacuum gaps and short circuits from feeder 814, buncher 816 and catcher 818. Parts 801 are made from another two wafers, or may be made from the same wafer. All parts are assembled and held together by pin guides 824 and can be fixed by screws to a test bed or a circuit holder in a VED using the holes 826. Other means of connecting and aligning the wafer layers may also be used.

Figure 8A:
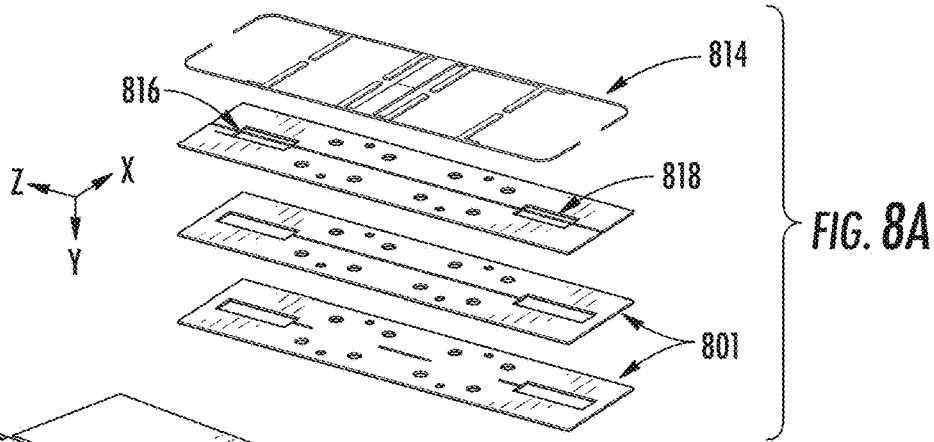
FIGS. 8A-8D represent several views of a klystron EM circuit fabricated from Si wafers.
Figure 8B:
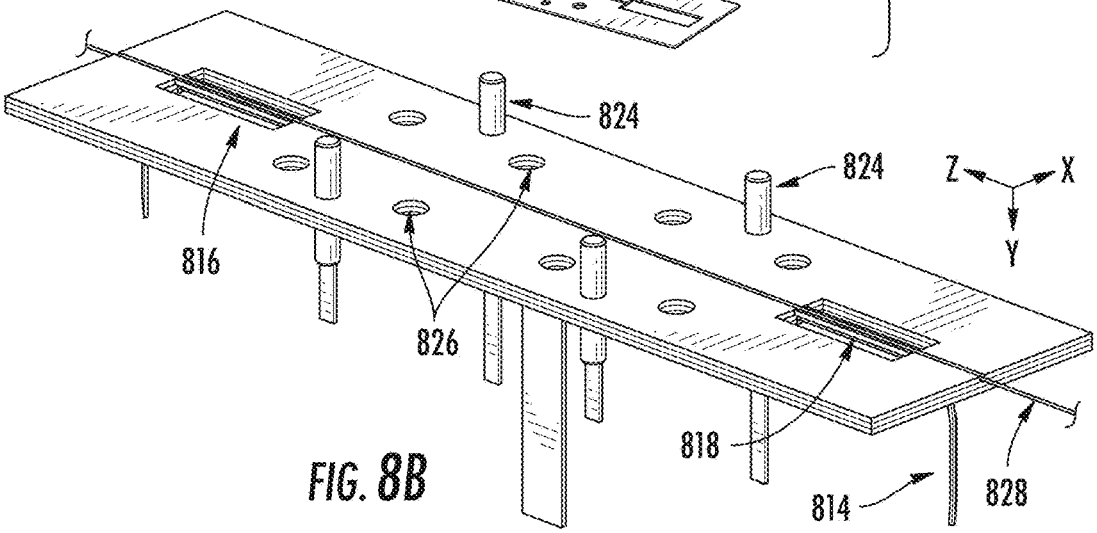
Figure 8C:
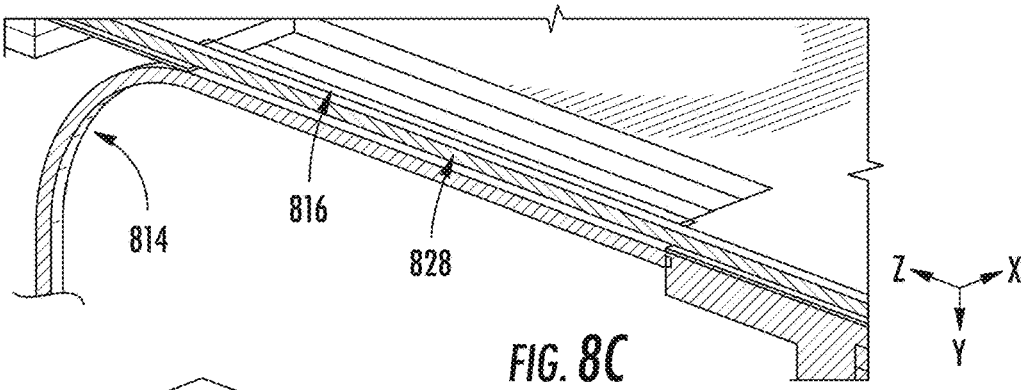
Figure 8D:
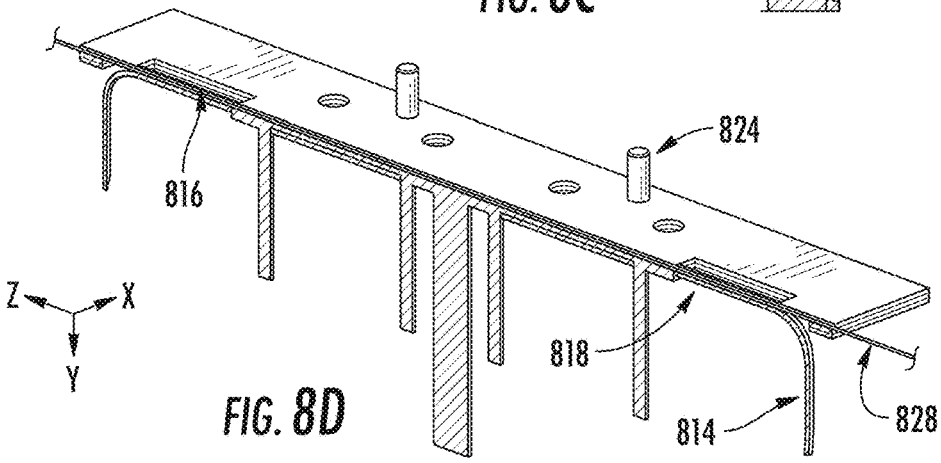

FIG. 8A shows a klystron circuit made from parts microfabricated from four 3-inch Si wafers in a stack. FIG. 8B shows the parts assembled as a stack on pin guides 824. FIG. 8C is a zoom view of the buncher 816 and its feeder 814. FIG. 8D is a cut view of the assembly of FIG. 8B.

FIGS. 8A-8D also illustrate the assembly steps for the Si wafer components. In one example, the feeder 814 shown in FIG. 8A is rotated and mounted orthogonally relative to buncher 816, catcher 818, and parts 801.

Figure 9A:
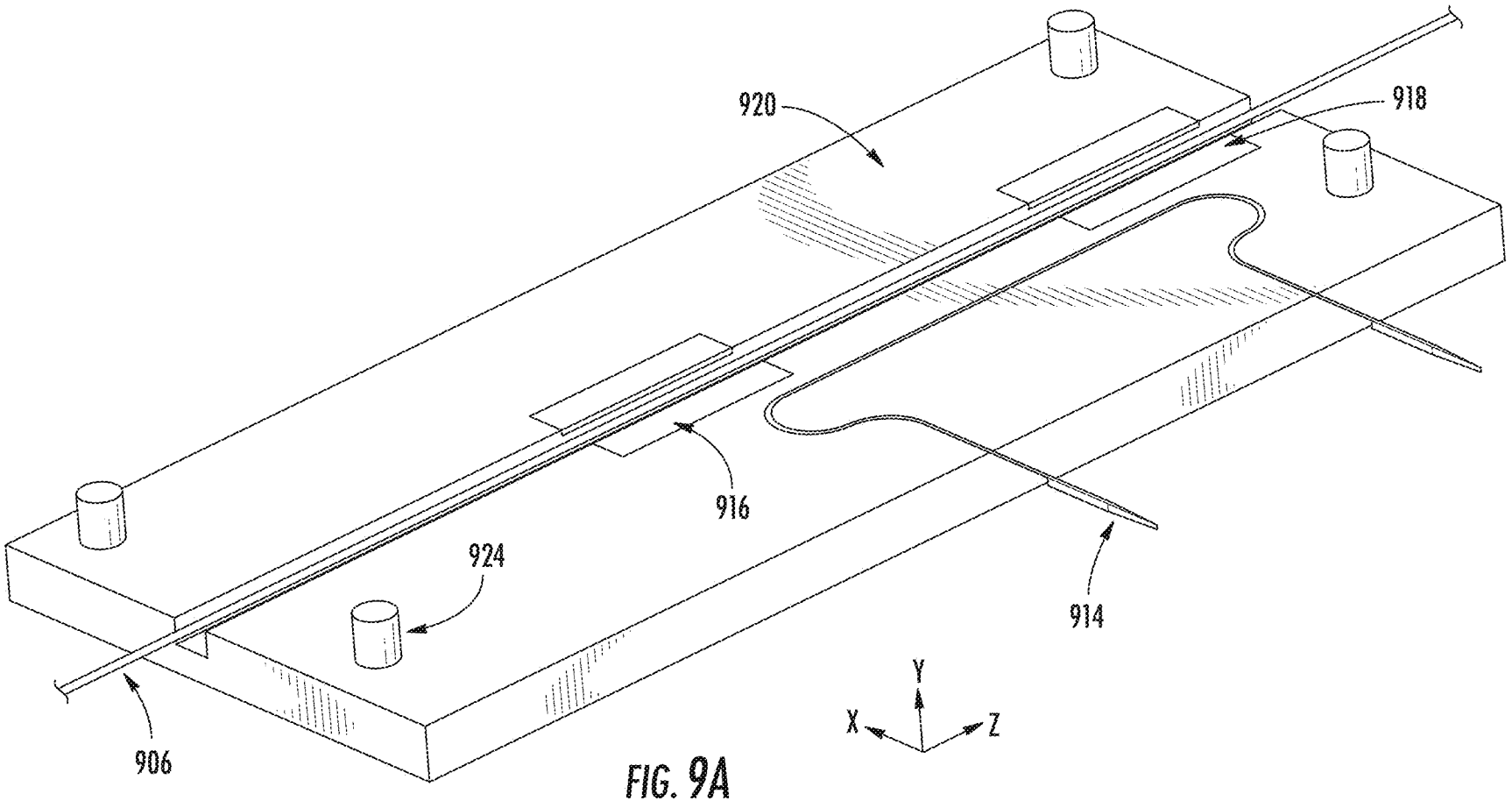
FIG. 9A-9B represent a klystron EM circuit mounted on a circuit holder configured as an amplifier and a generator, respectively.
Figure 9B:
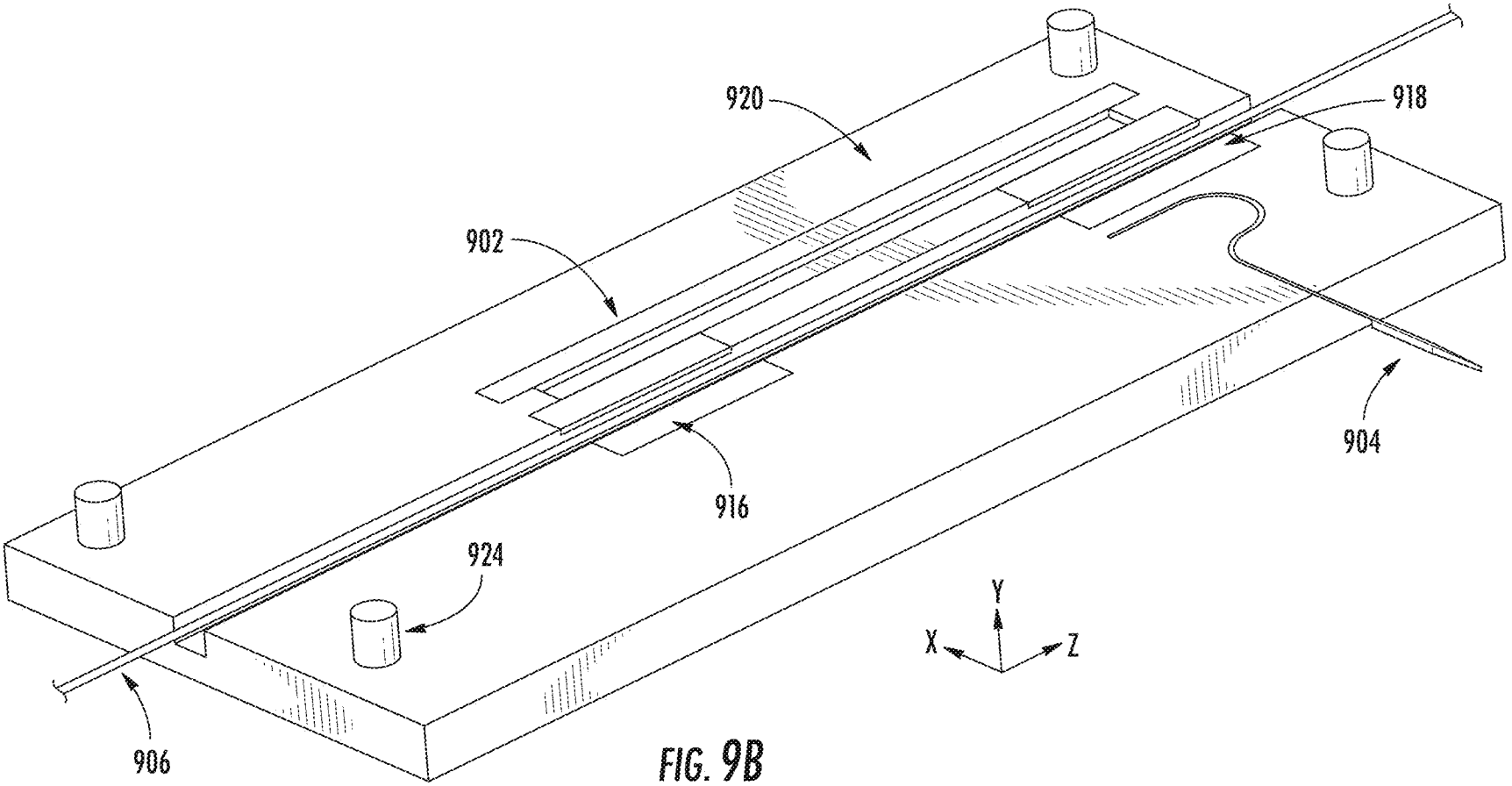

FIG. 9A presents a klystron mounted on a circuit holder configured to operate as an amplifier. FIG. 9B presents the klystron mounted on a circuit holder configured to operate as a signal generator.

FIG. 9A shows the EM circuit of an amplifier klystron including buncher 916, catcher 918 and feeder 914 mounted on a circuit holder 920. Buncher 916 modulates the velocities of electrons in the electron beam 906 so the electron beam enters the catcher 918 as alternating current. Then inside the catcher 918, the energy of the beam is converted into the THz signal. The feeder 914 is a type of directional coupler and couples an external low power input signal from a low power THz source to the buncher 916 and transfers the amplified signal from the catcher 918 outside the device. Pin guides 924 are used for precise alignment of EM circuit and the beam.

FIG. 9B shows an example of an EM circuit of a klystron used as a signal generator, including buncher 916, catcher 918, feedback path 902 and antenna 904 mounted on a circuit holder 920. Buncher 916 modulates the velocities of electrons in the electron beam 906 so electron beam enters the catcher 918 as alternating current. Then inside the catcher 918, the energy of the beam is converted into a THz signal. The feedback 902 is a section of Si DRW placed at a suitable distance to couple some power from catcher 918 back to the buncher 916. The high-power THz signal from the catcher 918 is radiated outside the device by the antenna 904. Pin guides 924 are used for precise alignment of EM circuit and the beam. The signal generator shown in FIG. 9B may be started from the inherent noise in the klystron circuit in one example or by means of an external signal or frequency source in another example.

Although FIGS. 9A-9B depict a holder 920 and pin guides 924, these components may or may not be used and other suitable means for fixture or maintaining the relative position of the Si DRW components relative to the electron beam 906 may be used in another embodiment.

Example 5. Cross-Field Devices with Round Si DRW EM Circuits

The following example shows how DRW EM circuits can be used in cross-field devices such as magnetrons, cross-field amplifiers (CFA) and others similar devices.

Figure 10:
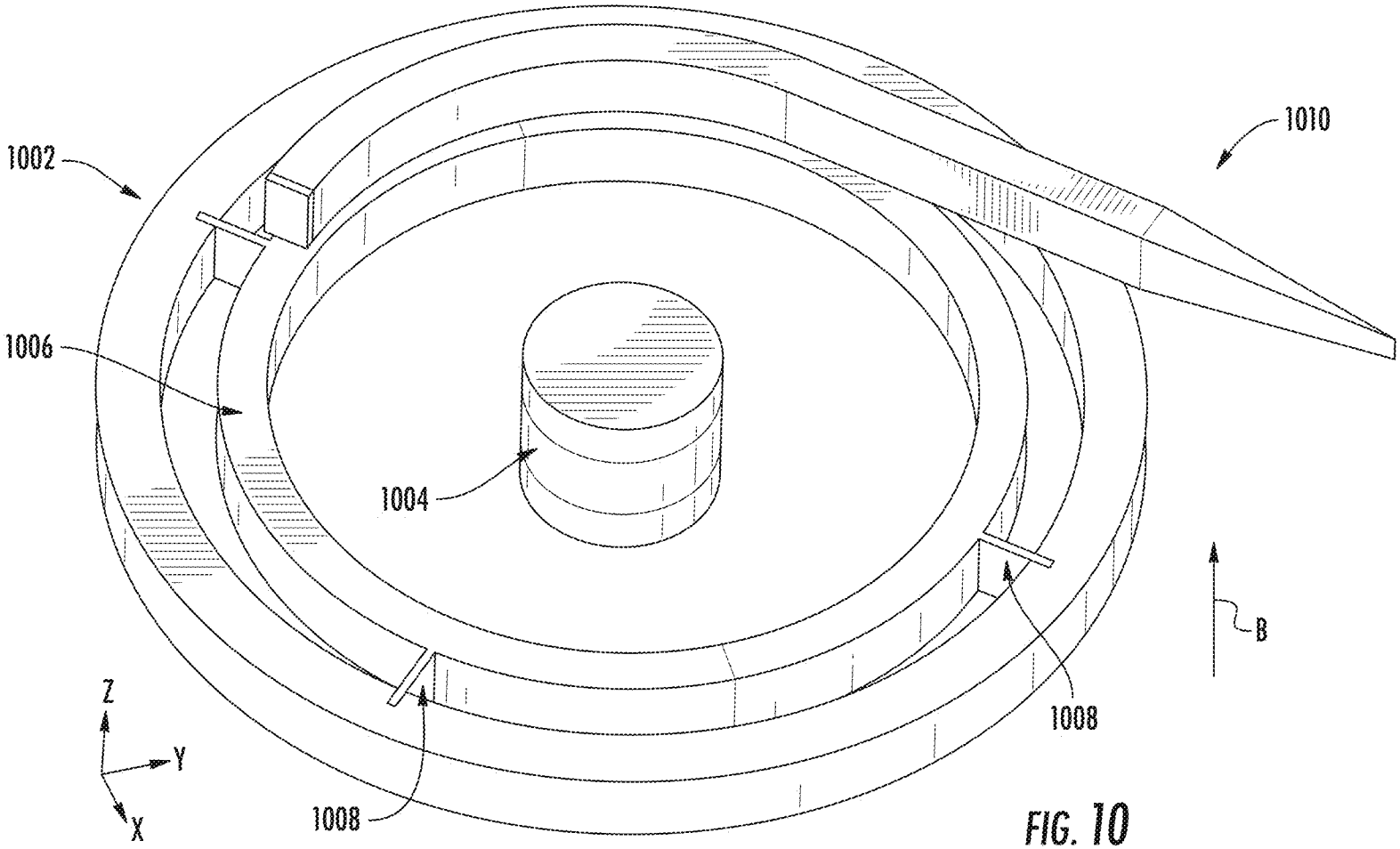
FIG. 10 represents a magnetron with a round DRW EM circuit.

FIG. 10 schematically shows a magnetron with anode 1002, cathode 1004, round Si DRW 1006, Si connections 1008 and Si DRW antenna 1010. Si DRW antenna 1010 serves to couple the generated RF signal out of the magnetron. In these devices, a constant electric field is directed radially from cathode 1004 to anode 1002. In the absence of the magnetic field, electrons would move radially from cathode 1004 to anode 1002. However, when a magnetic field (B) is applied perpendicular to the radial electric field (in Z direction), then the electrons tend to rotate around Z axis. Electric and magnetic fields can be configured such that electrons spin along a bent trajectory in the space between cathode 1004 and anode 1002. Typical trajectories of the electrons are represented by 1104 in FIG. 11B. Round Si DRW 1006 in FIG. 10 plays the same electromagnetic role as a round set of metal cavities or other round metal circuits used in classic magnetrons or other cross-field devices. The round Si DRW 1006 may be doped to have suitable electric conductivity and be connected to the anode 1002 by thin Si connections 1008. The conductivity must be low to reduce signal losses but must provide static charge evacuation to the anode 1002. Connections 1008 provide static charge evacuation from the Si DRW circuit and can serve as heat conductors. Its conductivity may be different (higher) than the Si conductivity of the round Si DRW 1006 or the connections 1008 can be metalized in another example.

Figure 11A:
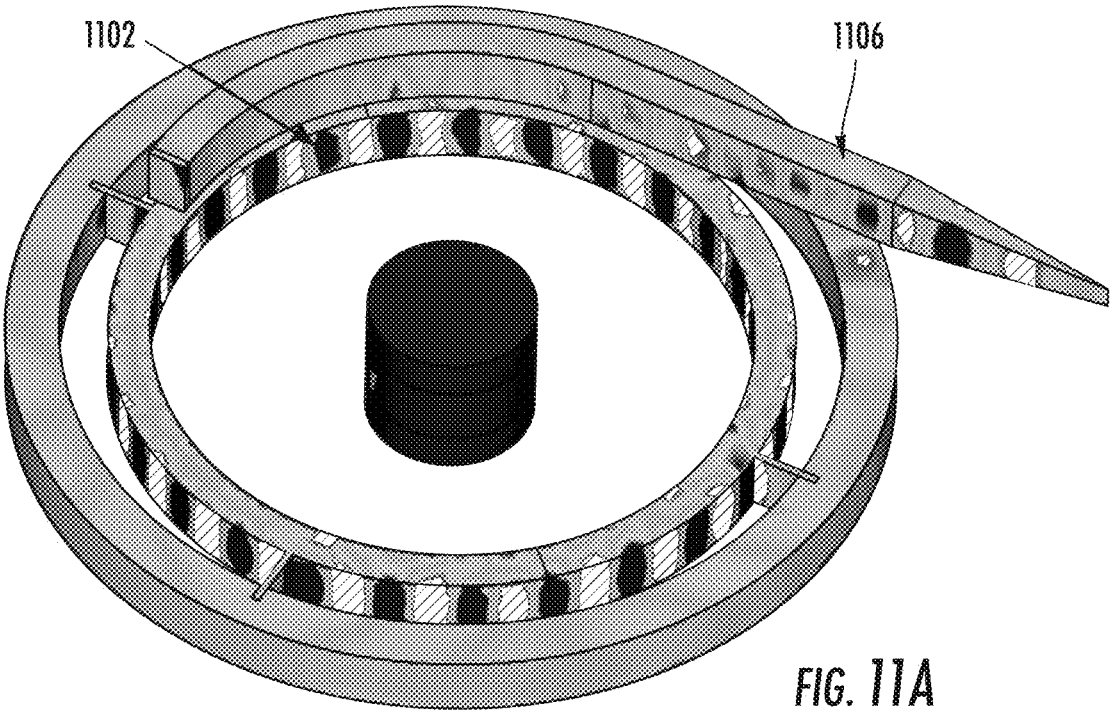
FIGS. 11A-11B represent a tangential field pattern on a round Si DRW and trajectories of the electrons in cross-field devices, respectively.
Figure 11B:
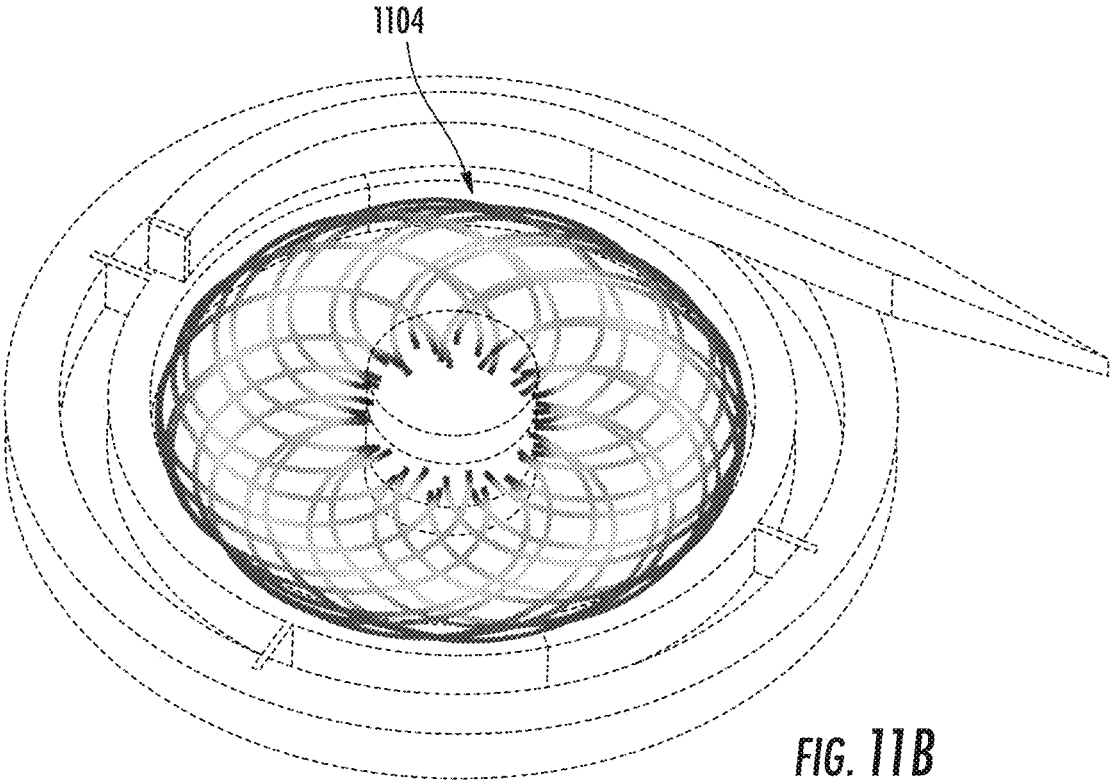

The round Si DRW 1006 can be designed to have, at working frequency, the tangential electric field pattern 1102, shown in FIGS. 11A-11B. This field pattern is suitable for efficient interaction between electrons and the EM circuit when the electrons move on their giro trajectories 1104 near the Si DRW surface. This interaction will lead to the generation (as in magnetrons) or amplification (as in CFA) of the EM signal. In one example, the generated EM signal may be coupled out of the magnetron in FIG. 11A by a DRW antenna or waveguide 1106. The coupling of the tangential electric field pattern 1102 with the field on the DRW antenna or waveguide 1106 is also shown.

Round Si DRW EM circuits may be particularly advantageous over metal or Si-based metal coated EM circuits in the THz band for the same reasons as they are in the case of linear devices. Unlike approaches using metal or metal coated parts, which require precise cavities or other complex 3D structures, the Si-based approaches enable the use of much simpler structures, for example a round DRW with a rectangular cross-section, as the EM wave propagates along the Si as opposed to being confined by a metal structure. Thus, Si DRW based EM circuits enable viable, efficient and inexpensive THz magnetrons, THz CFA, and other THz cross-field devices.

Figure 12:
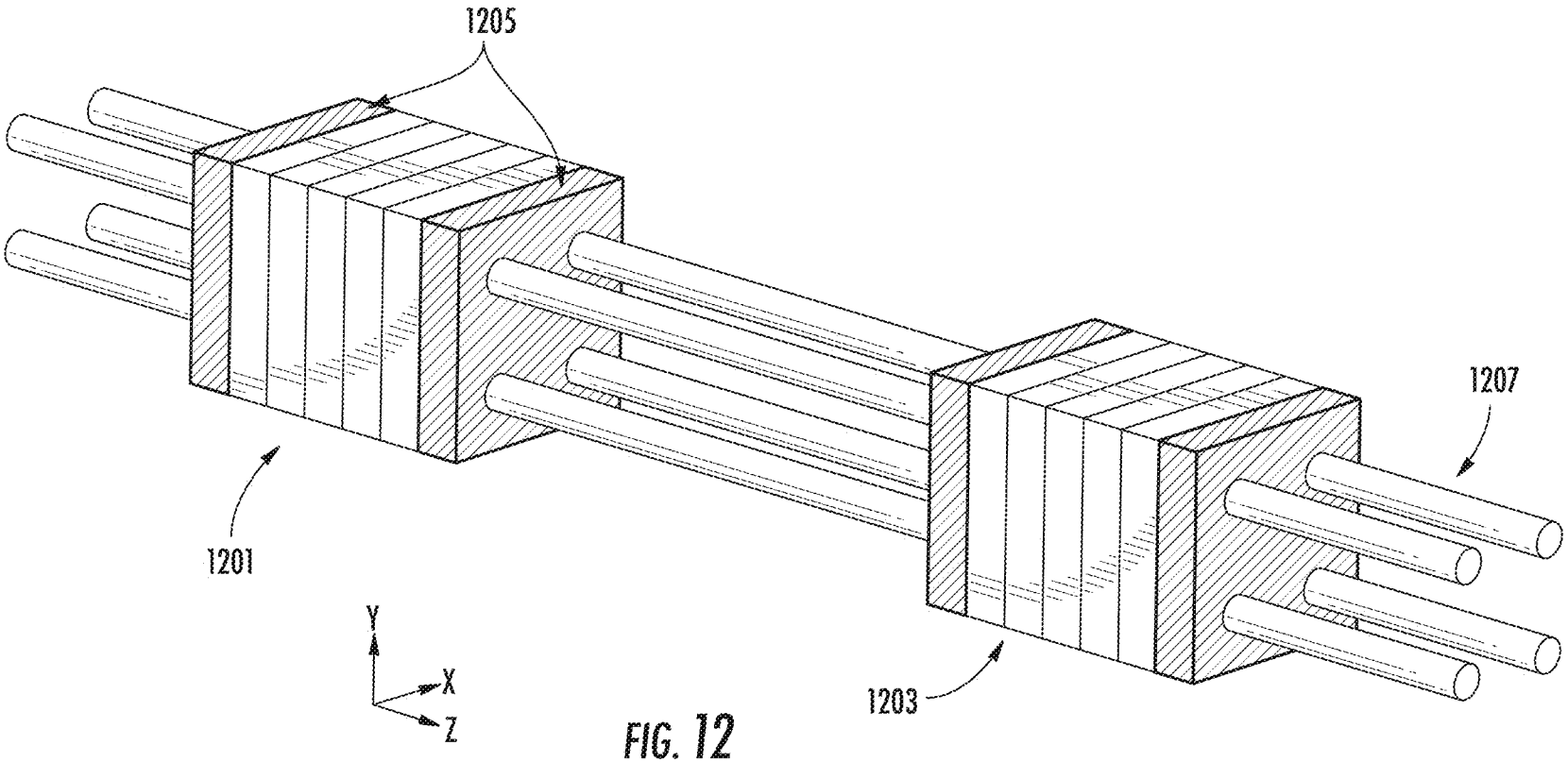
FIG. 12 represents an EM circuit of a multiple beam klystron with two high-order mode resonators, one for a buncher and one for a catcher, and four electron beams.

Example 6. High-Order Mode, Multiple Beam VEDs with Micro-Fabricated EM Circuits The following example shows how high-order mode micro-fabricated EM circuits can be used in multiple beam VEDs. FIG. 12 schematically shows an EM circuit of a multiple beam klystron with two high-order mode resonators. From an electromagnetic point of view, the resonators are high order mode Si DRWs, which may be stacked Si slabs or wafers in one example. Resonator 1201 may act as a buncher and resonator 1203 may act as a catcher. Resonators 1201 and 1203 can be considered stacked DRWs oriented around one or more electron beams 1207. Four electron beams 1207 are used in this illustration, but more than four beams or fewer than four beams may be used in another example. Plates 1205 are metal plates in one example, or metallization applied to Si or the DRW material to provide EM reflections in another example. The interaction between each electron beam 1207 with the surrounding electric field from the resonators 1201 and 1203 is similar to the single-beam klystron described in the Example 1, with multiple DRW bunchers and catchers clustered around the electron beam. The electric fields within resonators 1201 and 1203 may be generated from an EM wave introduced into the resonator, or generated from noise inherent to the resonator. The multiple beams approach is a way to efficiently increase the VED power using multiple low power beams.

Figure 13B:
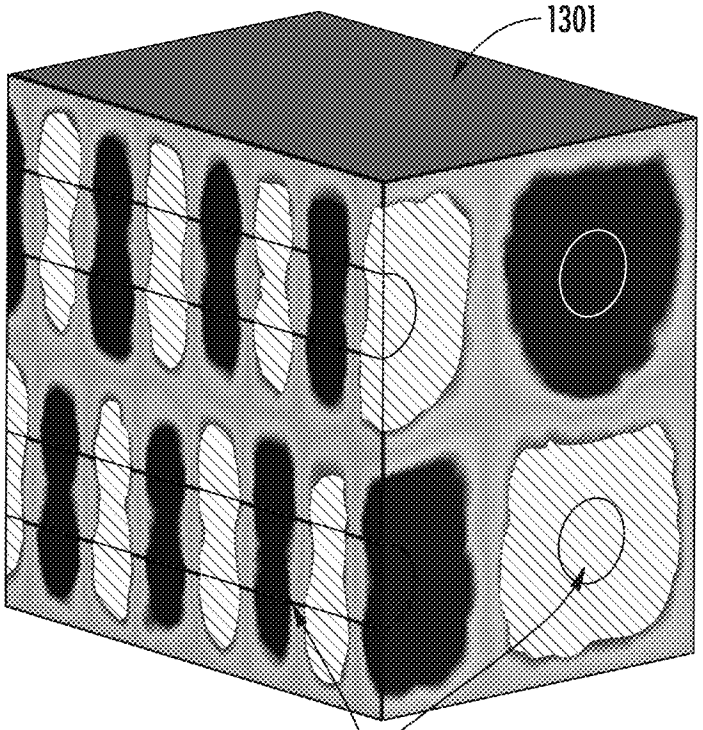
FIGS. 13A-13B represent high-order mode circuits for multiple beams incorporated in a VED with electron beam holes built by stacking multiple Si wafers with holes, and a longitudinal electric field pattern in a high-order mode circuit for multi-beam VEDs, respectively.
Figure 13A:
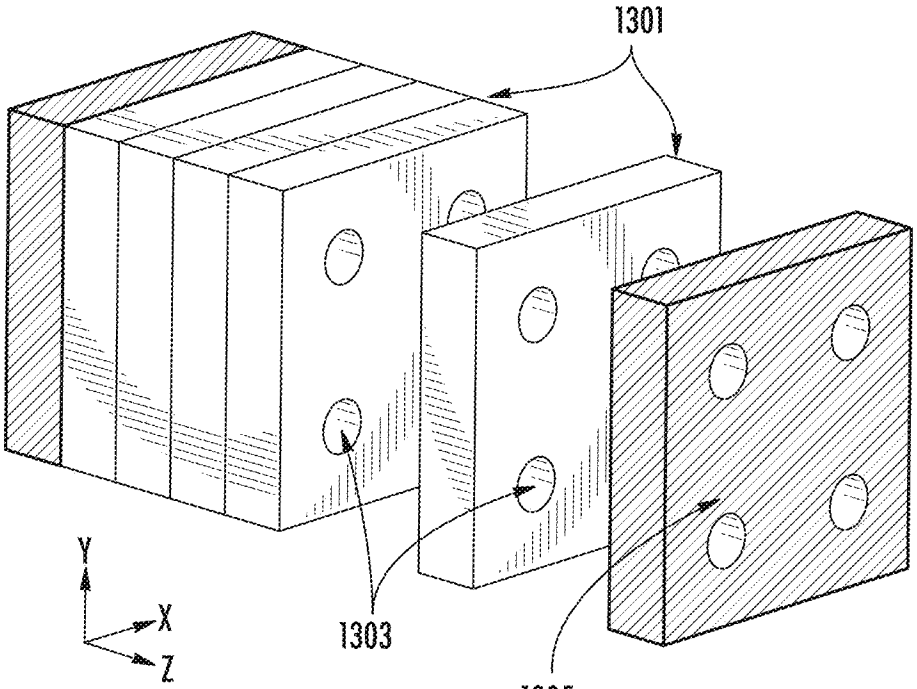

Details of the high-order mode resonators 1201 and 1203 shown in FIG. 12 are presented in FIG. 13A, which provides a simple solution for incorporating multiple beams into a VED. FIG. 13A presents a resonator comprised of multiple stacked dielectric wafers 1301 between metal plates 1305 each with an array of holes 1303 to accommodate multiple electron beams. Dielectric wafers 1301 may be Si DRW in one example, or other types of DRW in another example. Electron beams, such as beams 1207 shown in FIG. 12, may pass through holes 1303 in the wafers 1301. The electron beam may interact an electric field on the wafers 1301 acting as DRW. The electric field may be generated by an EM wave introduced to wafers 1301 by an external source in one example, or generated from noise inherent to the system in another example.

The circuits shown in FIG. 13A may have a suitable longitudinal electric field pattern shown in FIG. 13B because high-order modes can propagate when the transversal size of the DRW increases. In one example, the longitudinal electric field distribution at 300 GHz shown in FIG. 13B can be obtained with a Si DRW 0.6 mm×0.6 mm along its perimeter. The interaction between each electron beam, such as electron beam 1207 shown in FIG. 12, with the surrounding electric field from wafers 1301 and extending into holes 1303 can be made resonant, a condition when the mode phase velocity is approximately equal to the e-beam velocity, by adjusting transversal dimensions of the DRW in a similar manner as in the one-mode and one-beam klystron described in Example 1.

Figure 14:
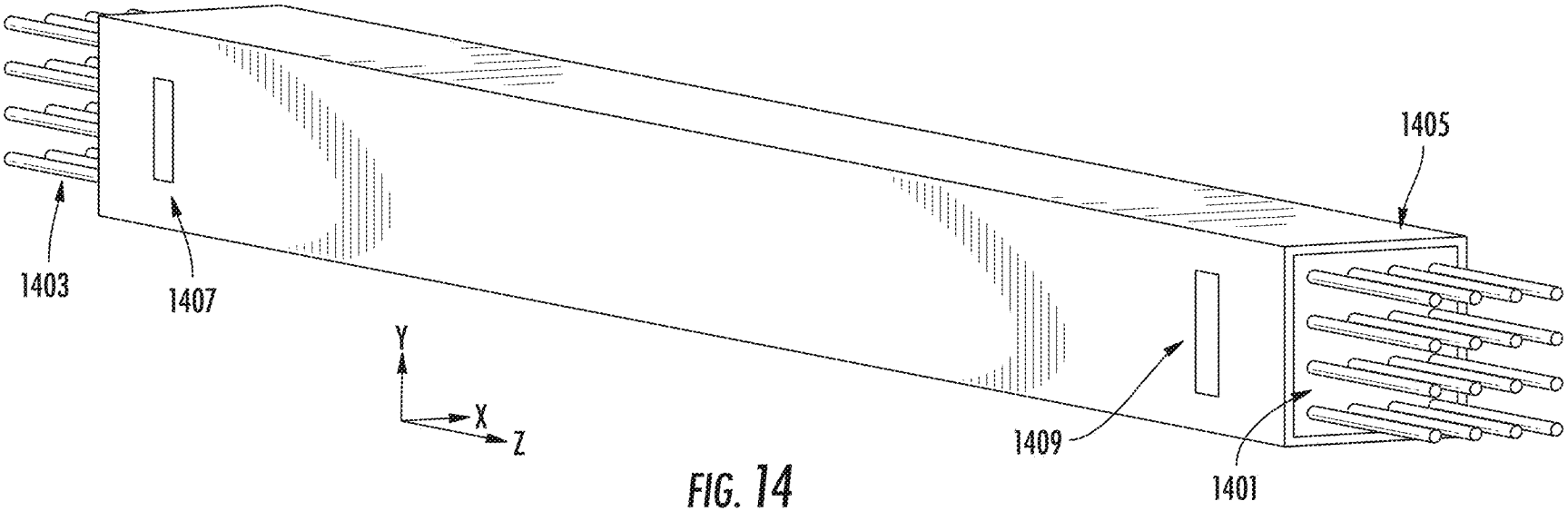
FIG. 14 represents a multiple beam high-order mode slow wave EM circuit for a 16 beam TWT.

FIG. 14 schematically shows a multiple beam, high-order mode slow wave EM circuit 1401 for a TWT. This example is for a device with sixteen electron beams 1403. In some embodiments, such circuits may be assembled in a metal housing 1405 for heat and static electricity dissipation. In another example, metal housing 1405 may not be present, rather a metallization may be applied the external surfaces of EM circuit.

Note that in this example the metal housing 1405 is an exterior housing or enclosure and does not inhibit the ability of the waveguides contained within the housing to interact with the electron beams 1403 also contained within the housing.

The biggest advantages of high-order mode multiple beams VEDs presented here is the possibility to efficiently scale up the THz VED power by simply adding up many low power/low perveance inexpensive beams. Such beams are easier to align, focus and control, and they are less damaging to the EM circuit, if the beams or a portion thereof contact the circuit. Eventual heat losses in such multiple beam high-mode circuits are distributed inside larger volumes, which also helps to avoid high temperature spots in the VED, reduce heat management requirements, and increase the lifetime of the VED. In one example, an input THz signal can be coupled to the TWT via a slot 1407 in metal housing 1405 and the output signal may be coupled to an output waveguide, antenna, or other output by a similar slot 1409 in the side of metal housing 1405. In another example, input THz signal and slot 1407 may not be used.

Resonators, such as resonators 1201, 1203 shown in FIG. 12 comprising stacks of dielectric wafers 1303 contained between plates 1305 shown in FIG. 13A, may be contained within metal housing 1405 adjacent to slots 1407, 1409 to enable transfer of RF energy into or out of resonators 1201, 1203. Slots 1407, 1409 may be in communication with a feeder, waveguide, antenna, conduit or other means for coupling a signal into or out of metal housing 1405.

The VEDs described herein include klystrons, TWTs and magnetrons, although other designs are also possible. They rely on the use of dielectric ribbon wave guides produced from silicon wafers in one example, and other suitable dielectric materials in another example to enable the amplification and generation of terahertz waves in a simple, cost-effective, and scalable design. These approaches also overcome many of the limitations of the current state of the art to generate terahertz signals as outlined below.

Example 7. Si DRW THz TWTs Assembled Inside Metal Housing

Figure 15:
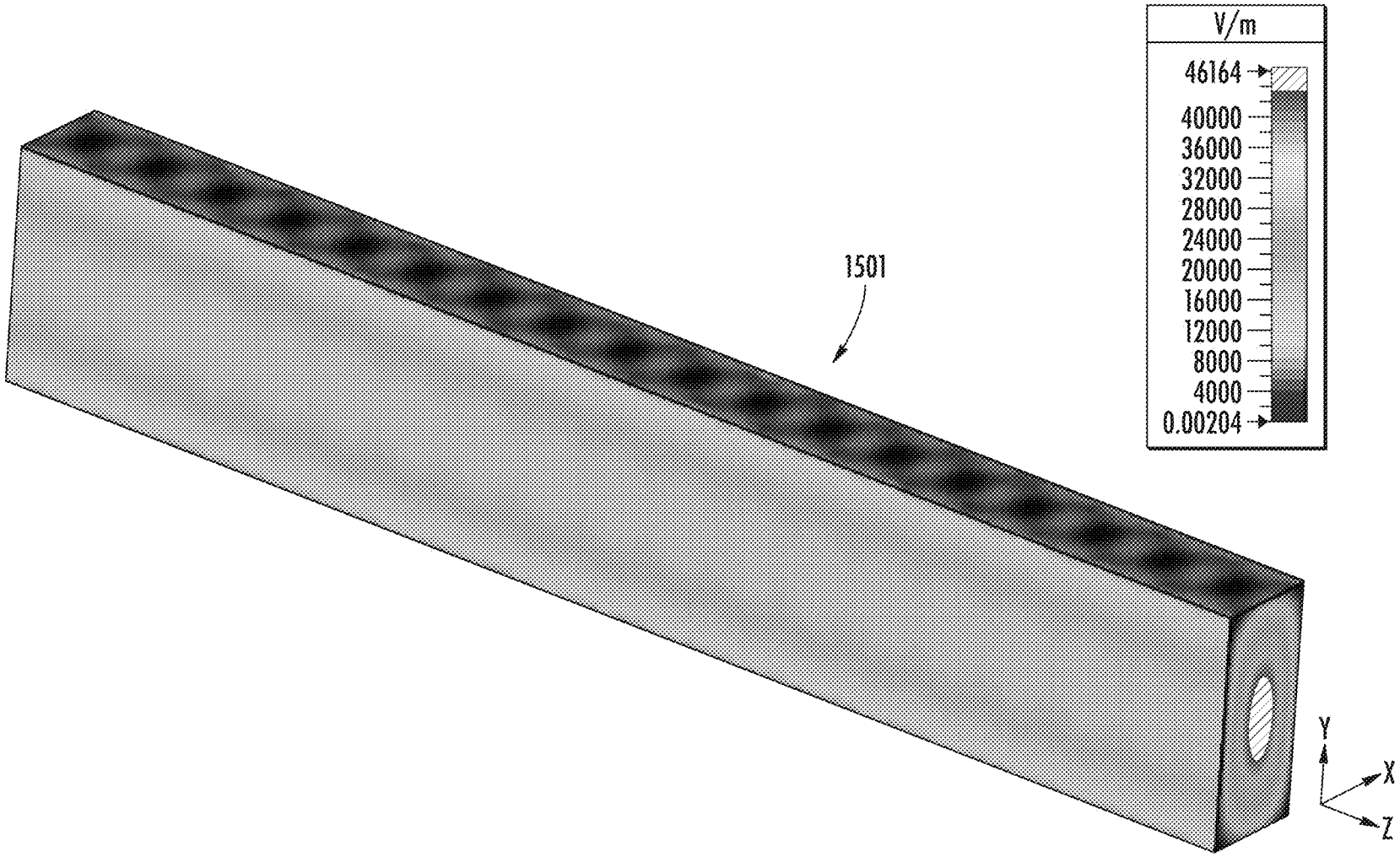
FIG. 15 represents a distribution of the absolute value of electric field of the first propagating mode of a Si DRW.

FIG. 15 illustrates the distribution of the absolute value of the electric field of the first propagating mode on a Si DRW 1501. The electric field may be generated by an external EM wave coupled into the DRW or initiated by noise inherent to the system by an electron beam passing adjacent to DRW 1501. In this example, the absolute value of electric field is zero along DRW edges. This means that any metal body touching the Si DRW along its edges would not alter this propagating mode.

Figure 16:
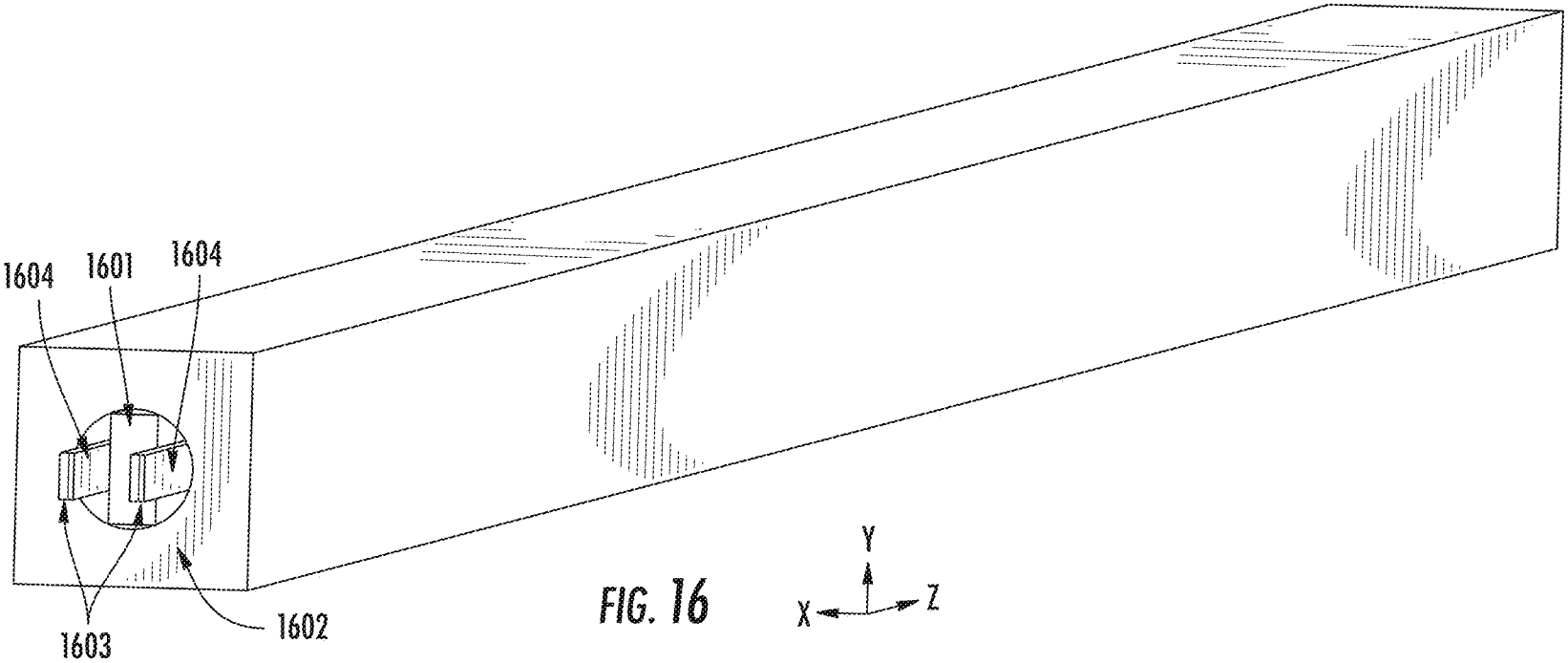
FIG. 16 represents a TWT assembled in a circular waveguide section.

This property can be exploited to assemble Si DRW based VEDs inside metal housings, in one example such housing being a conventional metal waveguide section, with circular or rectangular or any other suitable profiles. Such assembly would provide:

Solid holder for fragile and tiny Si DRW circuits
Heat sink to dissipate the heat from Si DRWs
Static charge grounding
Suitable for THz band manufacturing precision At the same time, such holder or housing does not alter the Si DRW interaction with the electron beam. Although the holder is described as being a waveguide in one example, the holder may be of any suitable construction, such as an external housing in another example, and may not necessarily be a waveguide. FIG. 16 shows a TWT 1601 contained within an outer housing 1602, which may be a circular waveguide section.

In one example, shown in FIG. 16, the outer housing 1602 is a circular waveguide section of 650 um inner diameter contains a Si DRW 1601 with cross-sectional dimensions of 250 um×600 um and provides the space for two ribbon electron beams 1604 produced by two cathodes 1603. In this particular example, the TWT would operate at approximately 300 GHz with an approximately 30 keV electron beam. Similar assemblies inside metal waveguides can be used for other types of linear THz VEDs, based on any other material DRWs, and other frequency ranges. Although two electron beams 1604 are shown, one or more than one beam may be used in another embodiment. In one example, an external RF signal may be coupled or input to DRW 1601 and in another example, the EM wave within DRW 1601 may be generated from noise inherent to the system by the electron beams 1604 passing adjacent to DRW 1601.

In one example, the outer housing 1602 may be a conventional waveguide, such as a copper or aluminum waveguide, widely available for use in a specific frequency range. Despite the use of a waveguide in this example, it should be noted that the electromagnetic wave propagates along the Si DRW structure and not along the surfaces of the waveguide. In other words, the waveguide does not serve to contain the signal, which travels along the silicon component. However, one benefit of using commercially available waveguides is their standard interconnect, which make it relatively easy to assemble the outer mechanical structure. Another benefit of using commercially available waveguides is the ability to connect, using standard interconnects, antennas, such as a horn antenna in one example, and other related components for coupling the radio frequency energy into or out of the Si DRW. In another embodiment, the outer housing 1602 may not be a waveguide but any other mechanical structure which serves as a fixture to hold the TWT or Si DRW 1601 in place relative to the electron beams 1604 and cathodes 1603. In yet another example, outer housing 1602 may not be used and the TWT or Si DRW 1601 may be held, clamped, or fixtured at one or both ends. In this example the electron beams 1604 (or beam if only one beam is used) and Si DRW 1601 may be mostly exposed and not covered by a housing.

The examples in FIGS. 15 and 16 further relate to a method for efficiently coupling energy from an electron beam to a Si DRW by generating an electric field within the DRW from EM waves induced either from noise inherent to the system or by an externally-supplied EM wave to the DRW, where the electric field corresponds to a first propagating mode with nulls (zero field) at the corners and edges of the Si DRW such that contact with a conducting medium at the corners or edges of the Si DRW will not alter the propagation mode. The method further involves maintaining a fixed relationship between the electron beam and the DRW by means of a mechanical fixture. This method relies on the fact that the DRWs as shown in FIGS. 1 and 2 allow for the EM fields generated by specific modes to extend beyond the surface to the DRW, thereby enhancing its interaction or coupling with a proximal electron beam, in one example.

Figure 17:
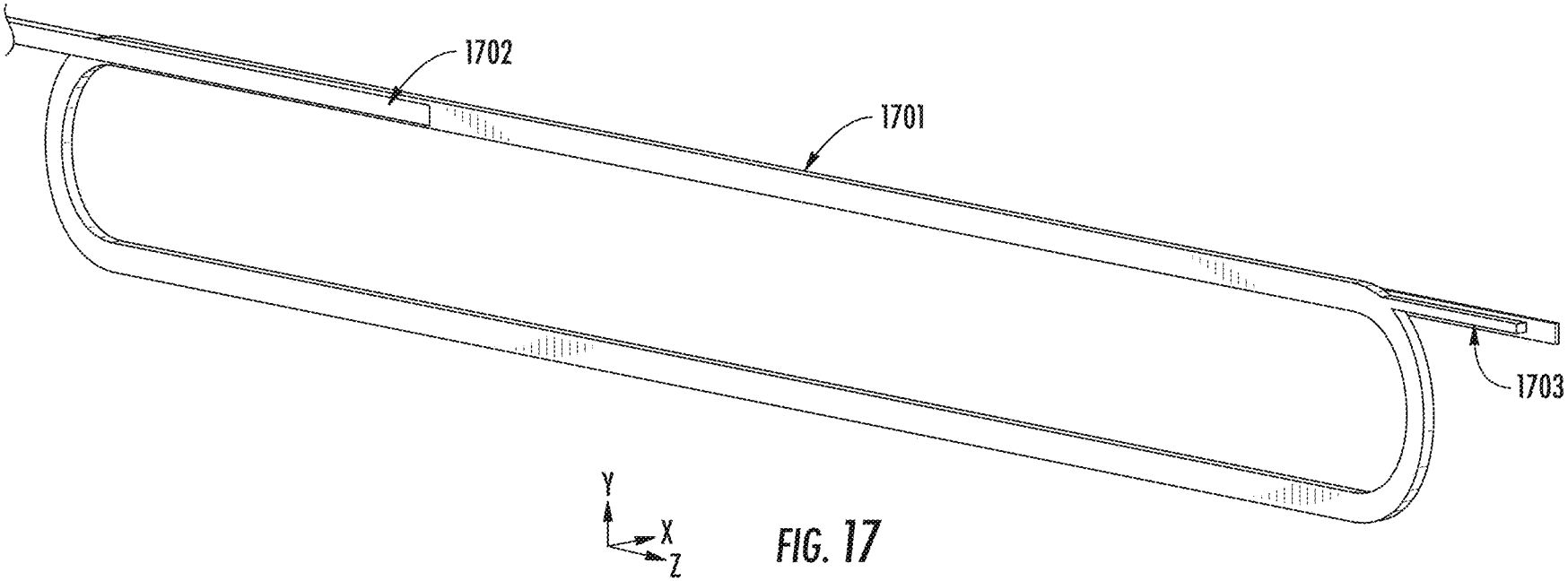
FIG. 17 represents a Si loop-based THz EIO.

One of the simplest VEDs for THz generation can be based on an enhanced interaction oscillator (EIO). In its classical example, an EIO contains a single resonator with many coupled cavities or a ladder like structure. Electrons coming through such resonator, in one example an electron beam directed through a resonator formed by coupled cavities or ladder-like structures, interact with many maxima and minima of the electric field from each cavity. Thus, their interaction is enhanced (in comparison with a single cavity of a simple klystron, for example). FIG. 17 provides an example of a loop-based EIO, containing an electron beam 1702, Si DRW loop 1701 and a Si coupler 1703 which couples some part (C), defined as the coupling coefficient, of the wave power from the loop to an antenna for example (not shown). In one example electron beam 1702 is split with one portion of the beam passing along the front side of loop 1701 and one portion of the beam passing along the back of loop 1701.

In one example, an initial wide-band wave train (or a short electromagnetic impulse) is induced somewhere on the Si DRW loop 1701 by an external source (not shown) such as an oscillator, a pulse source, or some other suitable means. In another example, noise inherent to the system may be used to initiate the signal propagation or wave train. This wave train containing many modes will travel around the loop. Every time it passes by the electron beam 1702, the resonant mode will be amplified by the electron beam as described in reference to Example 3 and the other modes will dissipate or die out. Even though the amplification (A) due to one complete round is low (A~1.2), after a certain number of rounds, a significant amplification of the resonant mode will take place. The amplification cycle will continue until the system reaches the saturation which occurs when signal power P_RF is 10%-50% of the e-beam power (P_beam). The e-beam efficiency at saturation may be defined as E=P_beam/P_RF. For actual RF power generation, the condition for coupling coefficient C<1-1/A must be satisfied. Thus, the following gives an approximate formula for THz power generated by a loop TWT with a coupler:

$$P_out = P_beam * E * C \quad \text{(Equation 3)}$$

where

E=P_beam/P_RF=(0.1-0.5) and C<1-1/A

In one example, with low power beam P_beam=10 W, A=1.2, and E=0.2. Then C<=0.16, P_out<=330 mW.

Figure 18:
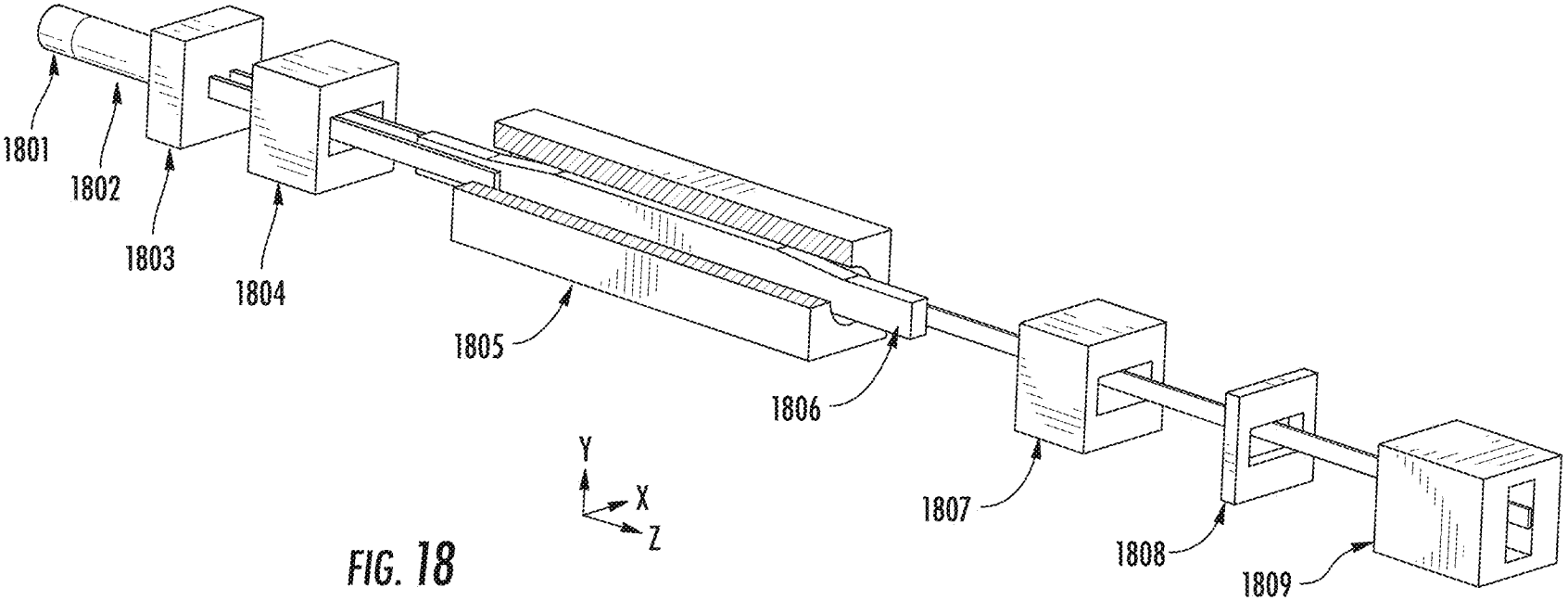
FIG. 18. represents an expanded view of a linear EIO contained in a circular waveguide section.

FIG. 18 shows expanded view of linear Si DRW 1806 EIO, assembled inside a circular waveguide 1805 (or other suitable holder, which may or may not be a waveguide) and fixed by two lateral holders 1804 and 1807.

In this example, cathode 1801 generates the electron beam 1802 which is accelerated to ~30 keV energy by surface 1803. Surface 1803 serves two purposes, as an anode and as an e-beam splitter to cut out or form a suitable e-beam transversal or cross-sectional profile for optimal interaction with Si DRW 1806. In one example, the optimal e-beam profile may be a sheet beam. In another example, a round beam profile may be used. In the example from FIG. 18, the e-beam profile is a double sheet beam, but other beam profiles may also be used. The electron beam splitter 1803 may contain holes or cut-out regions of any suitable geometry to form the desired electron beam profile.

In one example, an initial wave train travels in +Z direction in FIG. 18. The wave train may be introduced by an external source or generated from noise inherent to the system. In this example, the wave train will arrive at the end of the Si DRW 1806 amplified by an amplification factor, A, after which most of the wave energy will be reflected back along DRW 1806, with only some amount of the energy partly transmitted through the coupler 1808 (having coupling coefficient C) to output port 1809. The reflected wave, now going in −Z direction will again interact with e-beam; however, no net energy exchange will happen on its way back. Then the wave will reflect from the left end of Si DRW 1806 from surface 1803 and will be amplified again. So, round after round the wave amplification will continue via this oscillation process in the Si DRW 1806 until saturation. Coupler 1808 may be a waveguide section or waveguide spacer or a section of conduit which is designed to be below-cut-off at the working frequency. This can be achieved by appropriately defining the inner dimensions of such sections relative to the wavelength. In this case, the wave is completely reflected from the section which is under the cut-off frequency, if this section is long, but if such section is short, some wave power can leak through it. The amount of power leaked can be set by the coupler 1808 length. Power which is not leaked through the coupler 1808 is reflected backward, according to lossless waveguide theory.

The equation for output power of such EIOs is the same as for the loop EIO, discussed in reference to FIG. 17 and shown in Equation 3.

Figure 19:
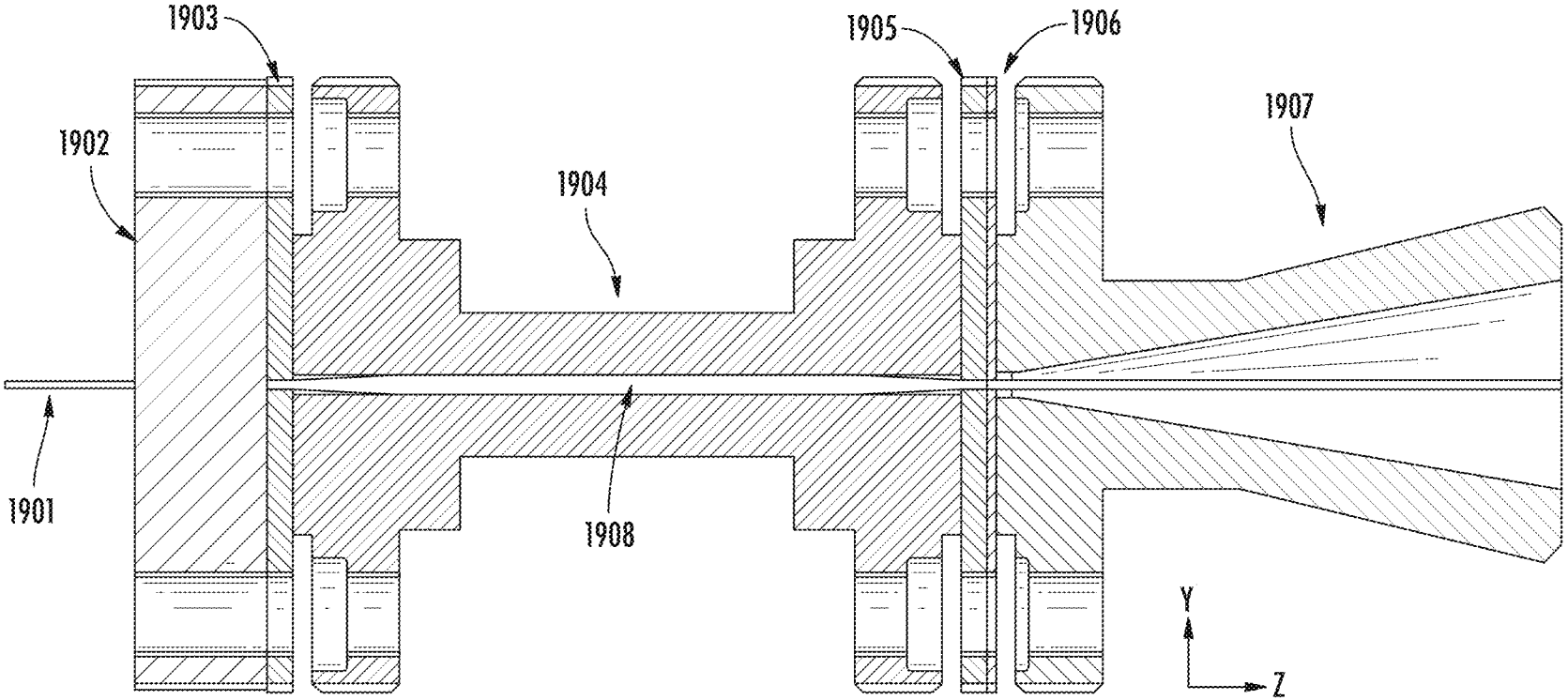
FIG. 19 represents an a linear EIO containing an EM circuit.

The linear EIO as shown in FIG. 18 can be assembled with the use of available standard waveguides sections, as depicted in FIG. 19 in one example, or using any other suitable components which may not be waveguides in another example.

FIG. 19 shows an electron beam 1901, a beam splitter 1902, lateral holders 1903 and 1905, circular waveguide section 1904, a coupler 1906, an antenna 1907, and a Si DRW 1908. One DRW 1908 may be used or multiple DRW 1908 may be used. In the case of multiple DRW 1908 they may be preferentially arranged around or adjacent to the electron beam 1901. In one example, two DRW 1908 may be arranged in parallel, with one on each side of the electron beam 1901 in one example. In another example, three DRW 1908 may be used arranged in a triangular shape with electron beam 1901 passing through the middle, in another example. Other arrangements are also possible with multiple DRW 1908. In this example, the waveguide 1904 serves primarily as a housing to mechanically protect the Si DRW 1908 and facilitate connections to lateral holders 1903 and 1905, coupler 1906 as well as to the output antenna 1907 and beam splitter 1902.

Coupler 1906 may function in the same manner as coupler 1808 described in reference to FIG. 18. The output antenna 1907 serves to radiate or transfer the THz signal generated by the EIO shown in FIG. 19 to an external system, component, (not shown), or free space. Antenna 1907 may be a conventional horn antenna, optimized for a specific terahertz frequency band in one example. In another example, antenna 1907 may be a waveguide to directly couple the output THz energy from the EIO to another system or component (not shown).

In another example, waveguide 1904 may be any other type of mechanical structure and may not be a waveguide. In yet another example, circular waveguide section 1904 may be omitted. It should be mentioned that the e-beam splitter 1902 may undergo high heat loads if the e-beam power is high. In this case, its design should be adapted and may use tapered holes, fins, or special materials to dissipate the heat loads or better sustain the heat loads.

Figure 20A:
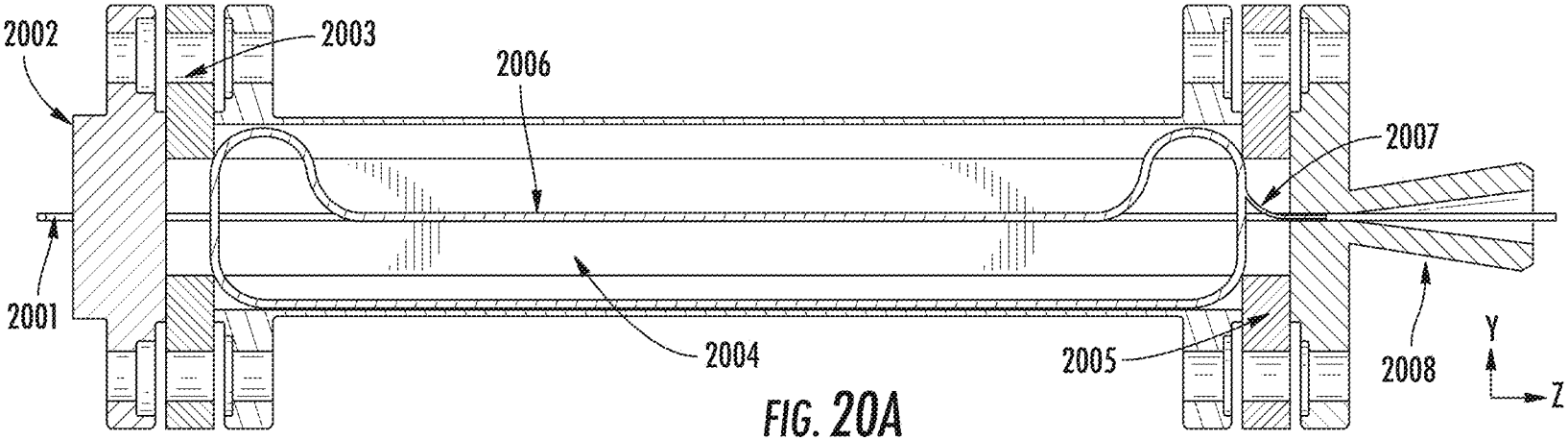
FIGS. 20A-20C represent a loop EIO assembly, a modified Si DRW insider the holder and a zoom view of the Si coupler to the antenna, respectively.
Figure 20C:
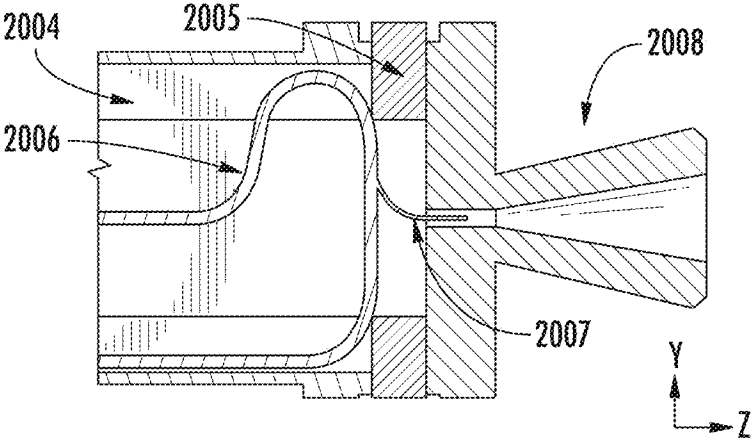
Figure 20B:
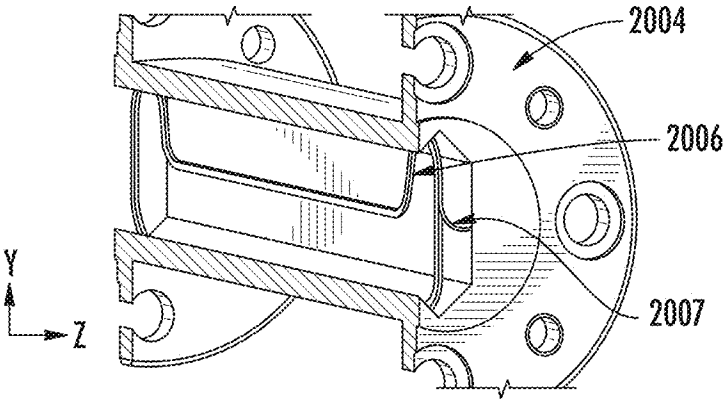

FIGS. 20A-20C shows an example of a loop EIO EM circuit assembled with the use of standard metal waveguide sections. FIG. 20A is a cutaway view, FIG. 20B shows a modified Si DRW loop inside the holder and FIG. 20C is a zoom view of the Si coupler to the antenna.

The assembly shown in FIG. 20A includes an electron beam 2001, beam splitter 2002, lateral holders 2003 and 2005, waveguide section or mechanical housing 2004, Si loop 2006, integrated Si coupler 2007, and antenna 2008. Multiple loops 2006 may be used or only one loop 2006 may be used. In one example, two loops may be arranged in parallel with the electron beam 2001 passing between them. In contrast to the linear EIOs shown in FIG. 18 and FIG. 19 where couplers are based on a waveguide section operating below cut-off in a loop EIO, coupling of output power to the antenna 2008 may be made by a Si coupler 2007 integrated into the loop 2006 shown in FIG. 20C. This is a kind of DRW power splitter where the coupler thickness defines the fraction of the power removed from or coupled out of the loop. In one example with reference to FIG. 20, the coupler 2007 may be 200 microns wide and 300 microns thick (as thick as the loop itself) and removes ~10% of the power at 300 GHz. In this example, the loop 2006 may be 300 microns thick. In a further example loop 2006 may be 300 microns thick to generate an output RF signal in the range of 280 GHz to 300 GHz. In another example, a coupler 2007 which is a half of the loop in width would remove ~50% of power from the loop. The coupler 2007 can be manufactured together with the loop from the same wafer with high precision, approximately 1 micron in one example, and with smooth surfaces.

In addition, coupler 2007 may be designed and precisely microfabricated to provide very smooth power division without disturbing propagating modes on the loop 2006 with reflections. The transition between loop 2006 and coupler 2007 can be made smooth because the coupler 2007 is tangential to the loop at the point of attachment. Further, the bend radius of coupler 2007 should be sufficiently large such that it is at least larger than the wavelength in vacuum in one example, and larger than several wavelengths in another example, to reduce radiative losses. In a particular example, the bend radius of coupler 2007 might range from 3 mm to 5 mm at 300 GHz.

FIG. 20C presents one example of coupler 2007 integrated into loop 2006, where the coupler 2007 is a curved section of Si DRW with a smaller cross-section relative to the cross-section of loop 2006. Coupler 2007 extends from the loop with a given curvature into antenna 2008 to couple RF energy from loop 2006 to antenna 2008. Microfabrication methods may also allow for other features to be incorporated into the coupler 2007.

In one example, coupler 2007 may have tapering toward the loop 2006, and in another example, coupler 2007 may be tapered away from the loop toward the coupler end. Such tapering may be used to reduce reflections and radiative losses. Tapering changes the wave impedance of a DRW. Tapering can be positive or negative and can be on any of two transversal dimensions. In one example, the tapering may be in the coupler 2007 width. In another example, tapering may be in the coupler 2007 thickness, and in yet another example the tapering may be in both the width and thickness directions. Tapering can be used to match the impedance of a coupler and of antennas or waveguides the coupler is coupled to.

In another example, the coupler 2007 can include a 90 degree bend, to send power upward or downward. In yet another example, two couplers may be present at different places on the loop 2006 to couple power into loop 2006 and to couple power out of loop 2006. Loop 2006 may contain more than two couplers in yet another example.

In a further embodiment, the end of the coupler 2007 (end furthest from loop 2006) can be made suitable to radiate the THz waves and act as a THz antenna. The radiation pattern of such antenna may be set up by the geometry. In one example, the tapering toward the radiating end may improve the antenna gain and/or optimize the antenna polarization. In general, microfabrication techniques allow any advanced antennas to be fabricated at the coupler end, including 2D and 3D antenna arrays.

In yet another example, coupler 2007 can couple or divide power between two loops 2006, or a loop and a linear DRW. More complex structures can be made from the same Si wafer to include multiple DRW components connected via couplers as 2007.

In yet another example, coupler 2007 may contain a metalized portion of the DRW on its external surfaces or sides to establish cut-off conditions for signals operating below the cut-off frequency. Thus, selective metallization of coupler 2007 enables it to be a high-pass filter in one example.

In yet another example, coupler 2007 may have a zone with reduced resistivity (resulting in increased ohmic losses) and act as an absorber or attenuator of unwanted EM modes or harmonics. In a Si DRW, for example, local modification of resistivity can be made by doping, or by creating the crystal lattice defects.

Figure 21:
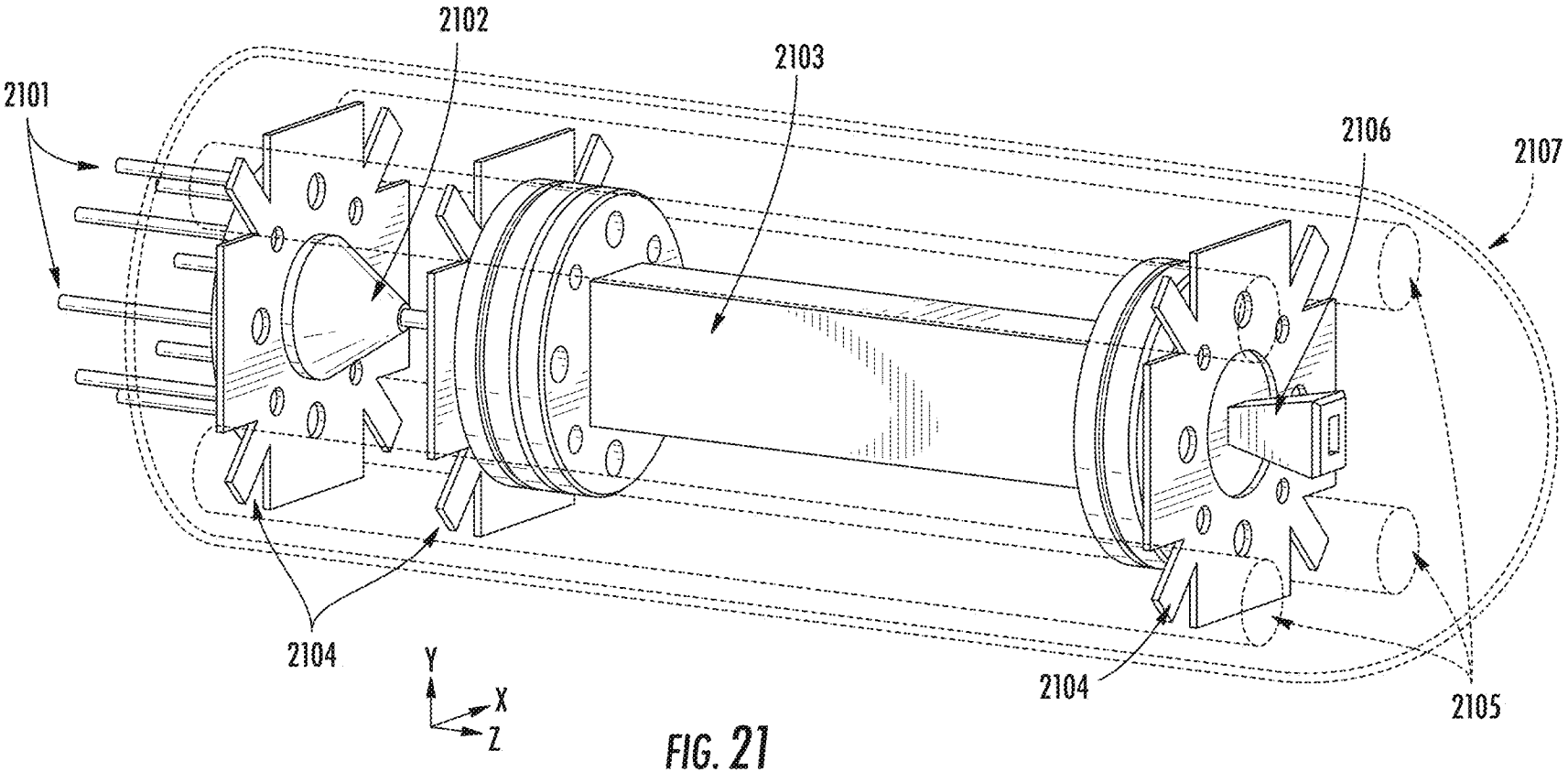
FIG. 21 represents a complete THz EIO inside a glass vacuum envelop.

An example of a complete EIO assembly in a glass vacuum envelope is shown in FIG. 21.

The system shown in FIG. 21 includes a glass rodding assembly inside a vacuum glass tube 2107 based on rods 2105 and jig surfaces 2104 to align the electron gun or cathode 2102 with EM circuit 2103. EM circuit 2103 may be set to the anode potential, thus providing acceleration to the electrons as they move from cathode 2102 to EM circuit 2103. Electrons leave the cathode 2102, accelerate toward EM circuit 2103 and then fly with constant velocity inside EM circuit 2103, generating a THz wave. Then electrons are dumped on the inner horn antenna 2106 surfaces. In this example, antenna 2106 also acts as a collector, which is further described with respect to FIG. 22. In another example, antenna 2016 and collector may not be the same component, but separate components. Electrodes 2101 serve to supply power to the cathode heater (not shown) and accelerate the electrons.

Figure 22A:
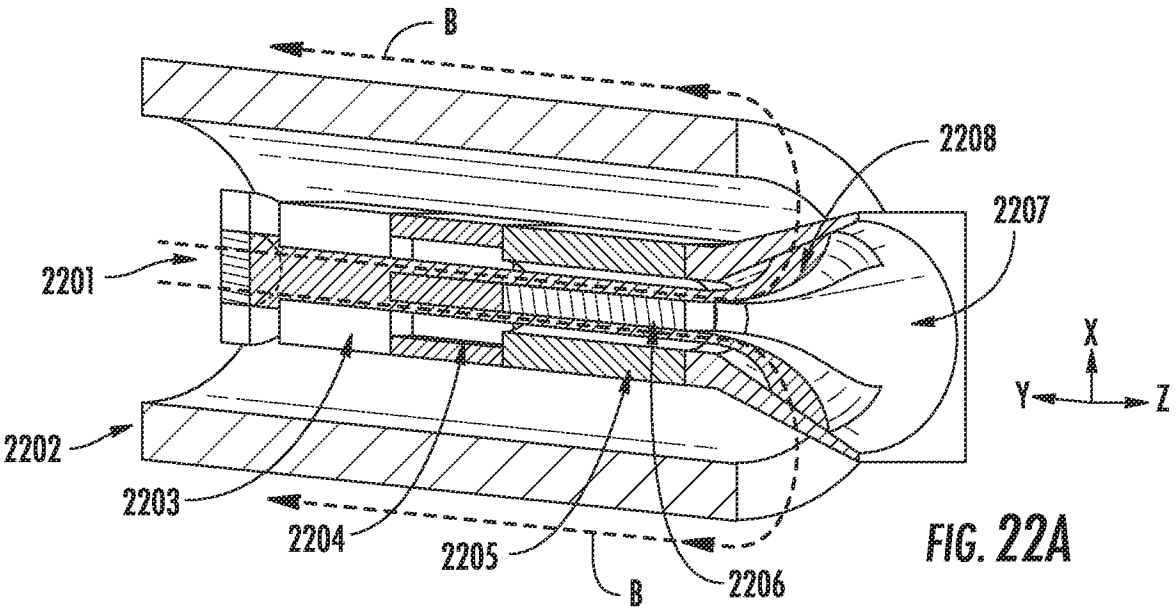
FIGS. 22A-22B represent a simplified electron beam alignment and focusing system and an expanded view, respectively.
Figure 22B:
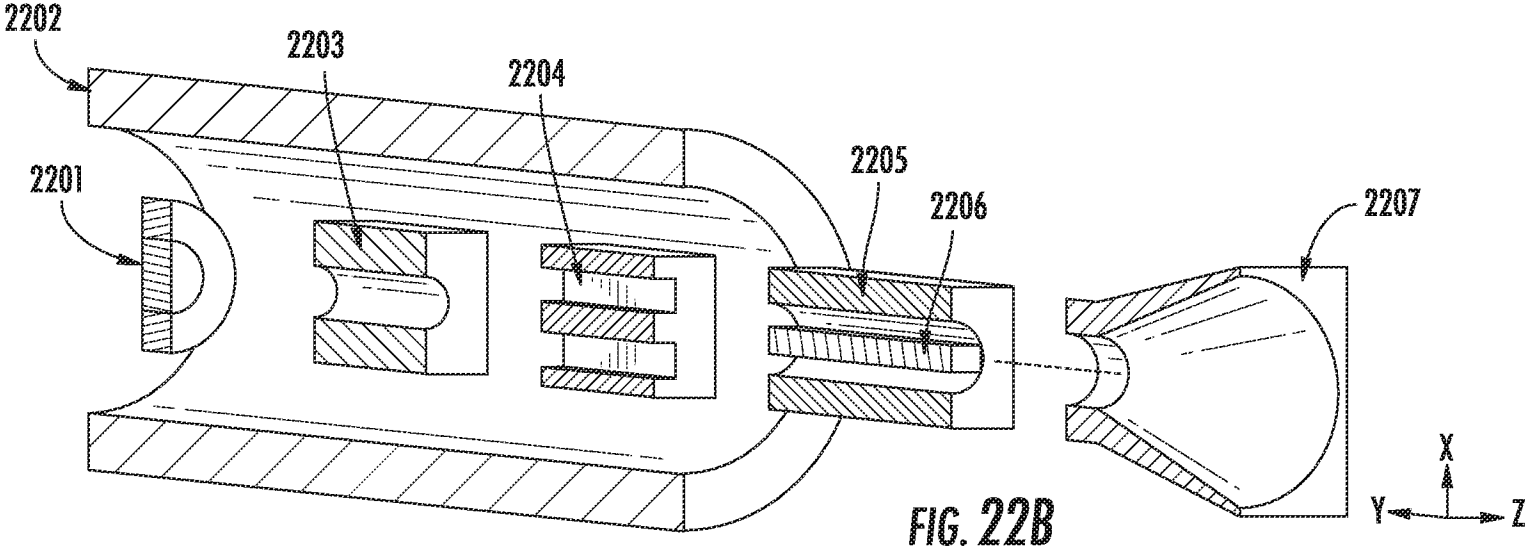

In one particular example, the system depicted in FIG. 21 may utilize simplified e-beam optics based on:

- Low total e-beam current
- Strong magnetic field created by long external solenoid or other magnet
- B-field threading of the cathode
- Oversized dispenser cathodes with ~5 A/cm$^2$ current density
- Beam shaver/beam splitter as the main element to form sheet e-beams
- Antenna acting as a collector Additional details are schematically depicted in FIGS. 22A-22B.

Shown in FIGS. 22A-22B are a cathode 2201, solenoid 2202, beam shaver 2203, beam splitter 2204 circular waveguide or housing 2205, Si DRW 2206, antenna-collector 2207, and electron beam 2208. FIG. 22B is an expanded cutaway view. FIG. 22A shows the electron beam 2208 diverted to collect on the antenna 2207. In another example, the antenna and collector may be separate components. It should be noted that FIG. 22A does not depict the vacuum envelope.

In one example, the system shown in FIG. 22A utilizes Si DRW EIOs which have high beam efficiency and can work with low power and low density (5 A/cm$^2$) e-beams. For this reason, the system does not need any beam compression to increase the current density inside the EM circuit. Thus, no additional electron lenses, typical in most of VEDs, are necessary. Because no electron lenses are used, a uniform magnetic field threading the device from cathode to the antenna may be used. In this example, the longitudinal magnetic field will freeze electron trajectories to the magnetic field lines. In this case the alignment of electron beam with EM circuit is equivalent to the alignment of the solenoid and EM circuit.

In one example, strong (0.1-1.0 Tesla) magnetic fields can be created by a solenoid 2202 external to the vacuum envelope. The solenoid 2202 may be positioned such that its magnetic lines cross the inner surface of the horn antenna 2207. This way electrons 2208 are directed onto the inner surface of the antenna 2207 which can also serve as a collector. In this example, a slightly oversized cathode 2201 may also be used, which allows for bigger tolerances in cathode transversal position.

Figure 23A:
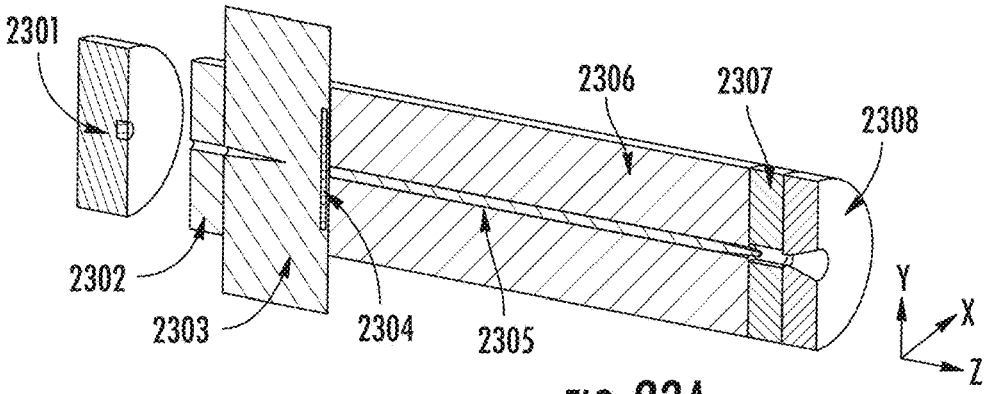
FIGS. 23A-E represents an EIO with all essential parts made from a single Si wafer and several views.
Figure 23B:
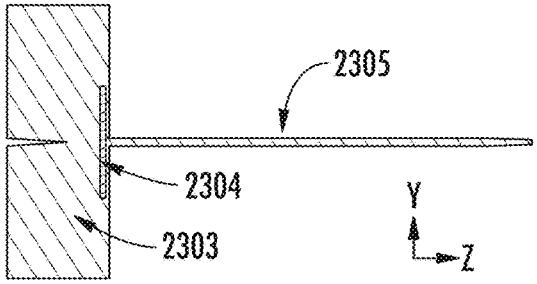

FIG. 23A shows a cutaway view of an EIO. FIG. 23B shows non-metalized Si part within metal insertion. FIG.

Figure 23C:
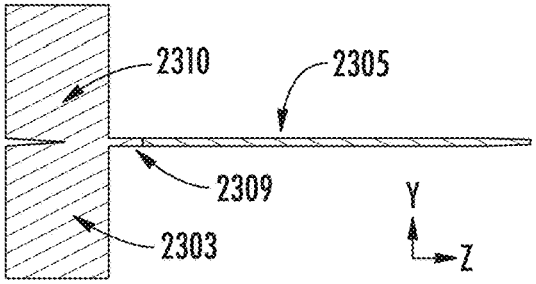
Figure 23D:
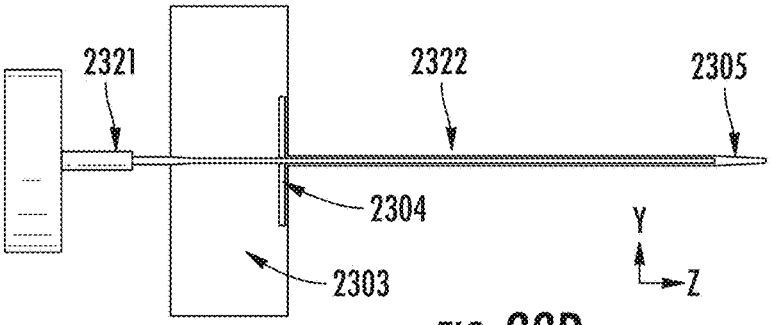
Figure 23E:
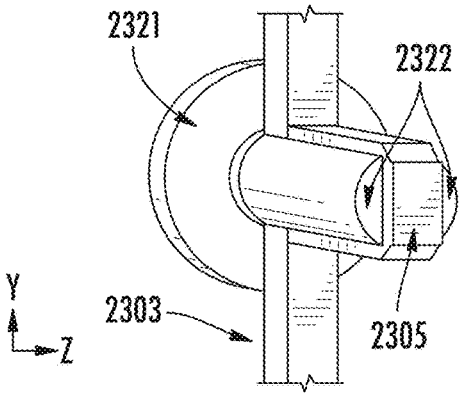

23C shows a metallized Si part. FIG. 23D show an electron beam side view and FIG. 23E shows an electron beam perspective view.

FIG. 23A shows an example of EIO containing a Si-DRW 2305 with an integrated beam splitter 2303 which may also serve as a fin to dissipate heat of the impinging electron beam. In another example, the beam splitter 2303 may not serve as a heat fin and only serve as a beam splitter integral to Si DRW 2305. In this example, beam splitter 2303 and Si DRW 2305 are effectively cut from the same piece of silicon (not separate parts), however beam splitter 2303 and Si DRW 2305 serve different functions.

In one example, the integrated components Si DRW 2305 and beam splitter 2303 can be produced or cut from a 300 um thick and 100 mm diameter Si wafer, although other wafer sizes and dimensions may be used in another example. The integrated Si part (beam splitter 2303 and Si DRW 2305) is contained within a slotted circular waveguide section or any other suitable housing 2306 or structure. In this manner the Si DRW 2305 is contained inside a circular waveguide or housing similar to Examples 7 and 8. Furthermore, the integral e-beam splitter 2303 and fins are in close contact with the metal surfaces of housing 2306 over a large area to help evacuate heat and static charges.

In one embodiment, an electron beam 2321 is generated from a round oversized cathode 2301 and accelerated toward anode 2302, which may also act as a round beam shaver. The beam splitter 2303 forms the e-beam profile 2322 optimal for interaction with EM circuit 2305, as shown in FIGS. 23D and 23E.

In one example, the beam splitter 2303 may undergo high heat and charge loads. The beam splitter 2303 may be made from a Si wafer, or other suitable material, and is tapered to better distribute and conduct the heat. The tapering offers larger area to the e-beam power absorption and this way reduces the heat flux and maximal temperatures. For example, if tapering angle is 9.0 degrees, then the maximal heat flux is sin(9.0) or ~1/6.4 of the non-tapered case. This tapering can be made with high precision (<1 um) and cost-effectively using Si wafer microfabrication methods, such as DRIE or others. The degree of tapering also serves to distribute the thermal load over a larger surface. In one particular example, the beam splitter 2303 may have fins for heat dissipation. These fins may be composed of only Si as shown in FIG. 23B depicting fins 2303 because Si has high heat conductivity ~148 W/K/m. Alternatively, the fins may be metalized as shown in FIG. 23C depicting a metallic coating 2310 covering beam splitter 2303 in one example. In yet another example, fins 2303 covered with metallic coating 2310 may be connected to bigger heat sinks (not shown). It should be noted that metallization 2310 serves to enhance heat transfer and protect the underlying Si or dielectric material from electron beam impingement.

Si DRW 2305 may act as a resonator with complete reflection at the left side and a partial ~10% coupler on the right side, in one example. The fraction of the reflected signal on the left side of DRW 2305 and fraction of coupled energy at the output of the circuit may vary, depending on the application. Complete reflection can be created by different methods. In one example, the reflectivity may be enhanced by a metal insertion serving as a mirror 2304, in another example by metallization which creates an evanescent section 2309. In yet another example, mirror 2304 or metallic coating 2310, or evanescent section 2309 may not be used.

Coupler 2307 and antenna-collector 2308 are similar to those described in Example 8.

The approach shown in FIGS. 23A-23E has the following advantages:

- E-beam profile forming element (beam splitter) is perfectly aligned with the EM circuit because it is integral to the DRW and is cut from the same silicon wafer.
- Efficient heat transfer from the system due to precision microfabrication, optimized tapering, high heat conductivity of Si and the heat transfer to Si fins and metal holders.

Approaches in the prior art require multiple individual parts be aligned independently. The present approach significantly reduces these complexities and is dependent only on the uniformity of the magnetic field generated by the solenoid and its alignment with the Si DRW 2305 and beam splitter 2303, which contains all essential parts of the VED already integrated and well aligned with high <1 micron precision. Therefore, integrating the Si DRW 2305 with a beam splitter 2303 which may also serve as a fin into a single component, in some examples, overcomes many of the limitations related both to the overall system assembly and alignment, as well as to the e-beam forming and heat management in THz VEDs.

The embodiments shown in FIGS. 23A-23E generally relate to a method for optimally aligning the beam splitter and DRW by cutting or fabricating them from the same piece of silicon or other suitable dielectric, and in another embodiment enhancing heat transfer from the beam splitter through integral fins and/or tapering of the beam entrance region. The method further includes means for preferentially metalizing a portion of the beam splitter to enhance its heats transfer characteristics and also serves to increase the proportion of the reflected signal.

In another example, where higher power is needed, the VED concepts described above may be based on pulsed e-beam and operate at a specified duty cycle. This is advantageous to produce high instantaneous power while reducing thermal loading of the components and improving cooling. In one example, the VEDs may contain an additional electrode to enable pulsed operation and a duty cycle <100%. The additional electrode (called cutter electrode, not shown) is placed near the cathode and can be biased by a pulsed negative potential which blocks the electrons for some period of time. In one example, a pulse of 9 ms out of 10 ms corresponds to a 10% duty cycle operation, and the heat loading is reduced by a factor of 10.

The VEDs described herein include klystrons, TWTs, linear and loop EIOs, and magnetrons although other designs are also possible. They rely on the use of dielectric ribbon wave guides produced from silicon wafers in one example, and other suitable dielectric materials in another example to enable the amplification and generation of terahertz waves in a simple, cost-effective, and scalable design. These approaches also overcome many of the limitations of the current state of the art to generate terahertz signals as outlined below.

How Si DRW Based Circuits for THz VEDs Overcome Limitation I.

Classical VEDs usually have complex 3D electromagnetic circuits made of metals: these are two metal cavities for simplest klystrons; a set of many different cavities in the case of enhanced interaction klystrons (EIK); long helix slow wave circuits in the case of TWTs, and the like. In the case of the THz band, fabrication (usually micromachining) of such 3D metal circuits is extremely complex and expensive because of its size (sub mm) and geometrical complexity (such as a helix for example) and often, the required precision (about 1 μm) cannot be achieved.

In contrast to the conventional approaches using metallic components, Si DRW-based circuits possess intrinsic simplicity as shown in FIG. 1A. Combining the dielectric ribbon waveguides shown in FIG. 1A enables a broad range of EM circuits to be inexpensively fabricated including for klystrons, TWTs or other variants. Additional examples are provided in FIGS. 2-24. In one example, microfabrication of Si DRWs and Si DRW-like structures from Si wafers may be accomplished with deep reactive ion etching (DRIE), or other wafer fabrication processes, which are inexpensive processes and can provide the precision necessary for THz band components.

How Si DRW Base Circuits for THz VEDs Overcome Limitation II.

Pure crystal Si is an excellent material for the THz band with one of the smallest losses of all known materials. Low losses result in higher efficiencies, requiring less input beam power and lower temperatures due to self-heating. Si also has a very low thermal expansion index (almost 10 times lower than most metals) meaning the size of the EM circuit will remain unchanged with normal temperature variations, thereby providing a degree of thermal robustness and ensuring the electromagnetic properties of the Si circuit remain unchanged with temperature variations as well. Other materials exhibiting the characteristics outlined in Table 1 may also be used.

How Si DRW Base Circuits for THz VEDs Overcome Limitation III.

The Si DRW, shown in FIG. 1A, are highly resilient to electrical breakdown. Furthermore, the design results in a unique longitudinal electric field distribution along the DRW enabling the electric fields in the DRW-based approach to be up to two orders of magnitude less than in conventional mechanical designs.

It is known, that in case of a klystron, the modulation voltage in the buncher should be high enough to keep the drift space reasonably short. In the catcher in order to efficiently convert the electron beam kinetic energy into EM energy, the voltages are usually even higher, up to about 50% of the anode voltage.

In practice, this means that in classical klystrons, based on metal cavities, the buncher and catcher should normally tolerate voltages up to tens of kV. In the case of a THz klystron based on metal cavities of sub-mm size (L_cav), such voltages (V_cav) may often lead to a very high, longitudinal electric fields (E_cav).

$$E_cav = V_cav / L_cav \quad \text{(Equation 4)}$$

$$V_cav = E_cav * L_cav \quad \text{(Equation 5)}$$

The resulting field of tens to hundreds of kV/cm can cause arcing, cavity damage and vacuum contamination.

However, Si DRW resonators, such as shown in FIG. 2A, can be used to build bunchers and catchers resilient to the electrical breakdowns and with high modulation voltages. The longitudinal electric field pattern in the resonator 202 is a standing wave 206. The longitudinal field distribution of this standing wave above the DRW upper surface is very much similar to the field distribution of many (N) cavities put in a row and oscillating with a phase shift of 180 degrees between neighbors. In this case, N is equal to the number of electric field antinodes in a given Si DRW resonator.

The velocity of the electrons in the beam can be chosen such that the electrons interact resonantly with the standing wave. This means that some electrons will see only the accelerating field of each "cavity" while others see only decelerating field of each "cavity" and others will cross all the "cavities" at ~0 equivalent field. In this situation, the equivalent modulating voltage (V_DRW) of the Si DRW based buncher or catcher is the sum of voltages of all "cavities". The equivalent modulation voltage in this case can be calculated using this formula:

$$V_DRW = 0.7 * E_DRW * L_DRW \quad \text{(Equation 6)}$$

$$E_DRW = V_DRW / L_DRW / 0.7 \quad \text{(Equation 7)}$$

Where L_DRW is the length of the buncher or catcher and E_DRW is the amplitude of the electric field at standing wave antinodes. L_DRW can be made virtually of any length, in practice up to several cm in one example, and longer or shorter in another example. For comparison, a metallic cavity would require a length, L_cav, for THz band of less than 0.5 mm. Thus, L_DRW/L_cav~10-100, meaning the electric field in the Si DRW THz klystron can be tens to hundreds times lower than in a metallic cavity based klystron and provide the same modulation voltage. In addition, the risk of electrical breakdown in Si DRW klystrons is also reduced by the use of Si, which has very high electrical strength up to 200 kV/cm.

How Si DRW Base Circuits for THz VEDs Overcome Limitation IV.

The distribution of the standing wave around the perimeter of the DRW results in a high local electric field around its perimeter, where it interacts with the electron beam passing nearby. Geometrically complex EM structures based on Si DRWs can be easily micro-fabricated with high precision. This gives an opportunity to design advanced and more efficient EM circuits (such as loop TWTs for example) which overcome the limitation affecting existing approaches utilizing metal structures that suffer from poor interaction between the electromagnetic waves and electron beam, resulting in low efficiency and high power requirements for the electron beam and the device.

Thus, the Si DRW based approach to THz VEDs presents a number of essential advantages over conventional metal EM circuits. These advantages overcome the major obstacles to mid- to high-power, efficient, and low-cost VED THz sources and amplifiers.

Figure 24:
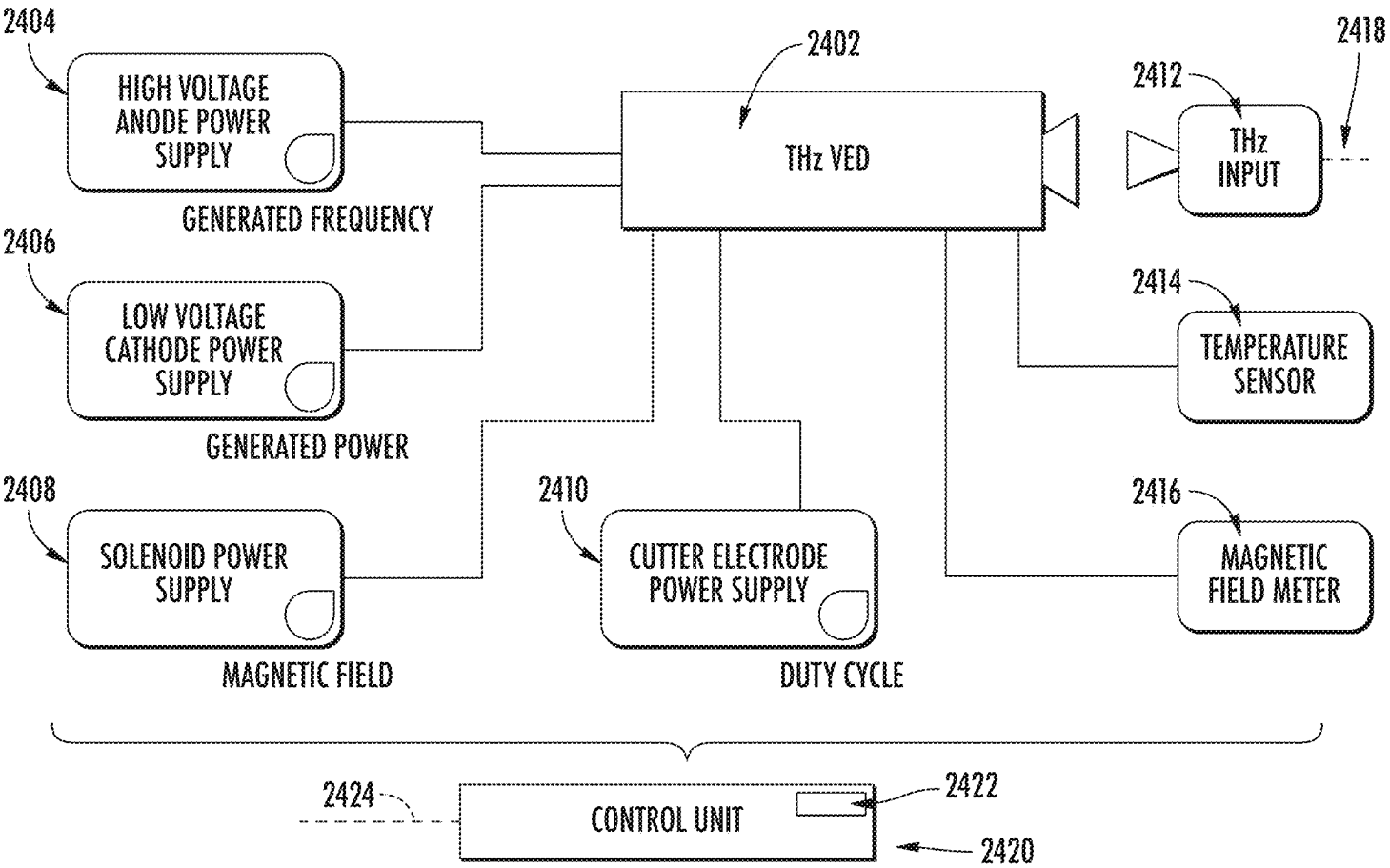
FIG. 24 represents a block diagram of a THz generation system.

FIG. 24 provides an example of a system used to control the THz VEDs of the types described herein.

In this example, a THz VED containing a Si-DRW EM circuit 2402 may be controlled by one or more inputs. A high voltage anode power supply 2404 may be used to supply high voltage to the anode which accelerates the electrons in the e-beam. Anode power supply 2404 may have a control to vary the anode voltage and thus vary the output frequency of the THz VED 2402 according to the principles described in Example 2. In one example, the anode power supply 2404 may be operated at a fixed setting, resulting in a fixed frequency output of the THz VED 2402. In another example, the anode power supply 2404 may operate with a variable voltage, such as a voltage sweep. In one example, the voltage sweep may be sinusoidal. In another example, any other variable voltage profile may be used.

A cathode power supply 2406 may be used to power the cathode heater. Increasing the cathode temperature, increases the cathode current, and as consequence the output THz power from the THz VED 2402 is increased as well. In another example, decreasing the cathode temperature will result in a decrease in power output from the THz VED 2402. Thus, the cathode power supply 2406 may be controlled to vary the THz output power.

A solenoid power supply 2408 is used to provide the required electric current to the solenoid and create the longitudinal magnetic field to align and focus the electron beam within THz VED 2402. The magnetic field strength influences the electron beam diameter and transmission (percentage of e-beam which passes from cathode to collector), so output from solenoid power supply 2408 may be used to control the magnetic field to optimize electron beam tuning to use the lowest possible field (lowest power consumption) for a given set of conditions, in one example.

In the case of pulsed operation, the THz VEDs may have a cutter electrode as described in Example 9. This electrode should be biased with a pulsed negative voltage, provided by the cutter electrode power supply 2410. This cutter electrode power supply 2410 may have controls to control pulse duration and voltage, thus defining the duty cycle of the THz VED 2402. In one example, the duty cycle may be variable. In another example, the duty cycle may be fixed. In yet another example, the THz VED 2402 may operate continuously without a cutter electrode power supply 2410.

The output from the THz VED 2402 may be coupled to a THz input 2412 via an antenna in one example, a waveguide in another example, or some other suitable means. In one example, the THZ input 2412 may be to an imaging system. In another example, the THZ input 2412 may be to a data transmission system. In yet another example, the THz input 2412 may be to a THz power meter to measure THz output power from THz VED 2402 and optimize the THz operating parameters via feedback signal to control anode power supply 2404, cathode power supply 2406, solenoid power supply 2408 and cutter electrode power supply 2410. In another example feedback signal from a power meter may be used to diagnose THz VED 2402. In yet another example, the THz signal from THz input 2412 may be directed via interconnect 2418 to another subsystem (not shown). In yet another example, interconnect 2418 may be an optical pathway. One or more than one THz input 2412 may be used. In one example, two THz Inputs 2412 may be used in conjunction with a power splitter (not shown) with one THz input 2412 serving in a feedback control capacity to control unit 2420 to control THz VED 2402 operation based on the feedback signal of THz VED 2402 output and another THz Input 2412 may be connected to an external system or device.

Additional inputs, including sensors, may also be used to control or optimize the operation of THz VED 2402. In one example, one or more temperature sensors 2414 may be used to monitor system component temperatures, whether internal to the THz VED 2402 or external, such as to prevent overheating in one example. In another example, magnetic field measurements 2416 may also be conducted for diagnostic or control purposes. Other sensors and inputs may also be used, such as current or voltage measurements.

System control unit 2420 may be digital or analog, or some combination of the two. In one example, control unit 2420 may contain a processing unit and non-transitory computer readable storage medium 2422 with instructions for carrying out system operations or diagnostics. An input and output data connection 2424 may enable control unit 2420 to communicate with components including anode power supply 2404, cathode power supply 2406, solenoid power supply 2408, cutter electrode power supply 2410, temperature sensors 2414, and magnetic field measurements 2416 as well as an operator or user interface, or network connection whether wireless or wired (not shown). In yet another example feedback from THz input 2412 to control unit 2420 may be used for closed loop operation. In another example, the system may operate with open loop control, or some combination. In one embodiment not all of the components shown in FIG. 24 may be used.

In yet another example, THz input 2412 may be an imaging system or the optical path of an imaging system, and control unit 2420 may further receive commands such as user inputs in one example, or commands from another control unit (not shown) in another example via interconnect 2424. In one example, inputs to control unit 2420 may serve to control the THz VED 2402 power output based on a desired brightness for the imaging system. In another example inputs from the imaging system to control unit 2420 may serve to modify the THz VED 2042 frequency of operation or frequency sweep parameters to enhance the image quality, such as reduce interference fringes, or improve image resolution.

In general, description of the terahertz generation system shown in FIG. 24 relates to a method for generating terahertz energy, which includes the following:

1. A control unit to command the operation of a high voltage anode power supply and a low voltage cathode power supply
2. The cathode and anode power supplies delivering electrical energy to the cathode and anode sufficient to generate and form an electron beam in a THz VED
3. The electron beam passing in close proximity to a DRW configured to preferentially operate at a mode resulting in electric fields extending beyond the DRW to interact with or couple to a portion of the energy contained in the electron beam, as shown in FIGS. 1-5, and further configured to maximize the longitudinal component of the field, which is responsible for efficient power exchange between the electron beam and the EM wave, at the beam location. At the same time, the transversal components can deviate or disperse the beam and must be reduced at the beam location
4. The electric fields extending beyond the DRW may be generated by electromagnetic waves either introduced into the DRW from an external source or initiated in the DRW from noise inherent to the system
5. The interaction of the electron beam with the electric fields extending beyond the DRW resulting in the generation or amplification of THz energy
6. The transmission of the terahertz energy from the THz VED to the surrounding environment or to an external source.

The method described above may optionally contain a solenoid and related power supply to further control and direct the electron beam in close proximity to the DRW contained within the THz VED, which may also include a method for capturing the electrons in the generated beam such the electron beam does not exit the THz VED. The generation of THz energy according to the method described above, may further be modified based on inputs from a control unit, which may include manual inputs in one example, or inputs from another control units or one or more sensors or input sources in another example.

Although the examples provided herein refer to the use of silicon as a preferred material for fabrication of the dielectric ribbon waveguide, any other suitable materials may be used. In another embodiment, other suitable materials with low losses and high refractive index in the THz band may be used. Examples of such materials are: gallium nitride, silicon carbide, indium gallium arsenide, or graphene and diamond among others.

The dielectric ribbon waveguide—based VEDs described herein are particularly well-suited to amplify terahertz signals in one example, or generate terahertz signals or energy in another example, depending on their type and design. In a preferred embodiment, the terahertz frequencies amplified or generated may be between 300 GHz and 3 THz. However, the techniques are equally applicable for to frequencies as low as 100 GHz and higher than 10 Thz in another example.

Those skilled in the art will surely realize that the steps described above may be carried out in another sequence without deviating from the intent and scope of the invention.

While particular embodiments of the invention have been shown and described, it will be obvious to those skilled in the art that various changes and modifications may be made without departing from the present invention in its broader aspects. It is intended that all matter contained in the above description and shown in the accompanying drawings shall be interpreted as illustrative and not in a limiting sense.

What is claimed is:

1. A vacuum electronic device for terahertz wave generation or amplification, comprising:

a vacuum enclosure containing:

a cathode and an anode for generating an electron beam;

a dielectric ribbon waveguide in close proximity to the electron beam;

wherein the dielectric ribbon waveguide is configured to operate at a mode to generate an electric field extending beyond its surfaces to interact with the electron beam to amplify or generate terahertz energy; and an antenna or interconnect for transmitting the terahertz energy out of the vacuum enclosure.

2. The device of claim 1, wherein the dielectric ribbon waveguide comprises an integral electron beam splitter.

3. The device of claim 2, wherein the integral electron beam splitter comprises fins for heat dissipation.

4. The device of claim 2, wherein the integral electron beam splitter is metalized.

5. The device of claim 1, wherein an magnetic field is used to control and align the electron beam.

6. The device of claim 5, wherein the magnetic field is generated by a solenoid.

7. The device of claim 5, wherein the magnetic field is generated by permanent magnets.

8. The device of claim 1, wherein the dielectric ribbon waveguide is silicon.

9. The device of claim 1, wherein the dielectric ribbon waveguide comprises an integrated coupler to transfer the amplified or generated terahertz energy to the antenna or interconnect.

10. The device of claim 9, wherein the integrated coupler comprises a tapered end and acts as an antenna.

11. The device of claim 9, wherein the integrated coupler is metalized and acts as a high-pass filter.

12. The device of claim 9, where the integrated coupler comprises a tapered end to act as a 2D or 3D antenna array.

13. The device of claim 9, where the integrated coupler has modified electromagnetic properties and acts as an absorber.

14. The device of claim 1, further comprising a control unit to change a voltage applied to the anode or a temperature of the cathode to vary terahertz energy frequency or output power.

15. The device of claim 1, wherein the antenna comprises an antenna-collector to collect generated electrons.

16. The device of claim 1, wherein the dielectric ribbon waveguide functions as a traveling wave tube, an enhanced interaction oscillator, a klystron, or a magnetron.

17. The device of claim 1, wherein the dielectric ribbon waveguide is a linear element.

18. The device of claim 1, wherein the dielectric ribbon waveguide is a loop.

19. The device of claim 1, wherein material properties of the dielectric ribbon waveguide are homogenous.

20. The device of claim 1, wherein material properties of the dielectric ribbon waveguide are inhomogeneous.

21. A vacuum electronic device for terahertz wave generation or amplification, comprising:

a vacuum enclosure containing: a cathode and an anode for generating an electron beam;

more than one dielectric ribbon waveguide in close proximity to the electron beam; wherein the more than one dielectric ribbon waveguide is configured to operate at a mode to generate an electric field extending beyond its surfaces to interact with the electron beam to amplify or generate terahertz energy; and an antenna or interconnect for transmitting the terahertz energy out of the vacuum enclosure.

22. A vacuum electronic device for terahertz wave generation or amplification, comprising:

a vacuum enclosure containing:

more than one electron beam;

a dielectric ribbon waveguide in close proximity to the more than one electron beam;

wherein the dielectric ribbon waveguide is configured to operate at a mode to generate an electric field extending beyond its surfaces to interact with the more than one electron beam to amplify or generate terahertz energy; and an antenna or interconnect for transmitting the terahertz energy out of the vacuum enclosure.

* * * * *